United States Patent [19]

Gidewall et al.

[11] 3,939,624

[45] Feb. 24, 1976

[54] PACKAGING APPARATUS

[75] Inventors: Kenneth L. Gidewall, Clarendon Hills; Larry W. Heavner, Glen Ellyn, both of Ill.

[73] Assignee: C. V. P. Systems Inc., Lombard, Ill.

[22] Filed: Mar. 4, 1975

[21] Appl. No.: 555,284

Related U.S. Application Data

[63] Continuation of Ser. No. 364,305, May 29, 1973, abandoned.

[52] U.S. Cl. ..... 53/112 B; 53/79; 53/386

[51] Int. Cl.[2] ..... B65B 31/06

[58] Field of Search ..... 53/112 B, 79, 386

[56] References Cited

UNITED STATES PATENTS

| | | | |
|---|---|---|---|
| 2,368,624 | 2/1945 | Walton | 53/112 B |
| 2,732,988 | 1/1956 | Feinstein | 53/112 B |
| 2,840,964 | 7/1958 | Kissling | 53/112 B |
| 2,927,410 | 3/1960 | Doyen et al. | 53/386 X |
| 2,963,838 | 12/1960 | Harrison et al. | 53/79 |
| 3,182,432 | 5/1965 | Canfield | 53/112 B |
| 3,289,387 | 12/1966 | Stagmeier | 53/112 B |
| 3,376,690 | 4/1968 | Jianas | 53/112 B |
| 3,430,414 | 3/1969 | Ludwig et al. | 53/79 |
| 3,516,223 | 6/1970 | Andersen et al. | 53/112 B |
| 3,518,809 | 7/1970 | Ott | 53/112 B |

*Primary Examiner*—Travis S. McGehee

*Attorney, Agent, or Firm*—Molinare, Allegretti, Newitt & Witcoff

[57] ABSTRACT

A process and apparatus for packaging articles, particularly fresh meat pieces, in a substantially gas impermeable flexible container. In the packaging of fresh meat, the process enables the meat to be held for extended periods of time, and yet the natural color of fresh meat is maintained and the bacteria growth does not exceed limits which would cause the meat to be considered inedible. The fresh meat is first placed in an open, substantially gas impermeable flexible container. Hollow passage defining means are inserted through the open portion of the flexible container, and while the top is being temporarily sealed, the container is vacuumized for removing substantially all the air and oxygen therefrom. After the air is removed, carbon dioxide is added to the container, the concentration of the carbon dioxide being such as to avoid significant bacterial growth on or in the meat over extended periods of time, while avoiding discoloration of the meat. Thereafter, the passage defining means are removed from the container, and the container is sealed, preferably by heat sealing, to prevent the egress of carbon dioxide therefrom and the ingress of air thereinto.

71 Claims, 31 Drawing Figures

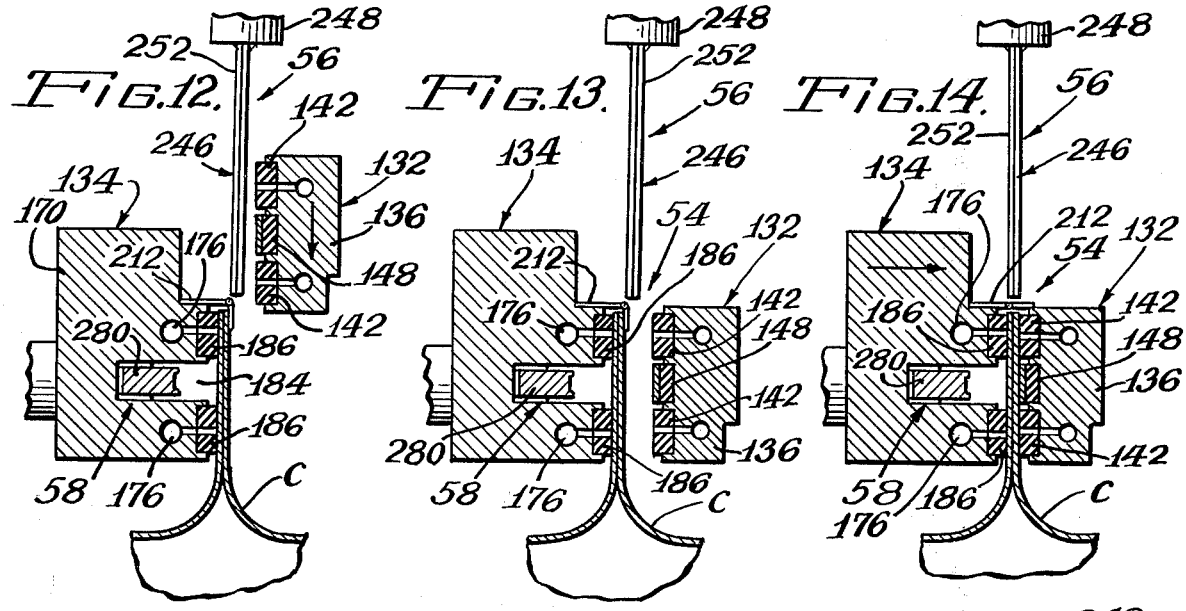
FIG.12.
FIG.13.
FIG.14.
248
252
56
246
142
132
136
148
134
170
212
176
280
186
184
58
C
54
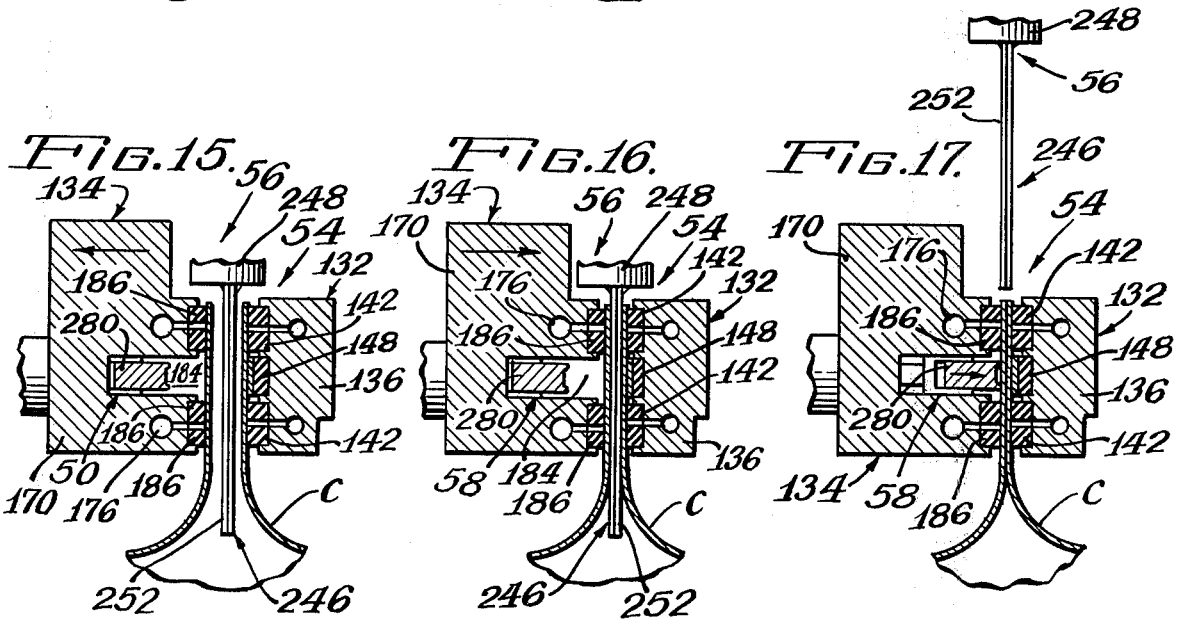
FIG.15.
FIG.16.
FIG.17.
248
56
252
246
54
134
170
176
186
280
184
142
132
148
136
50
58
C
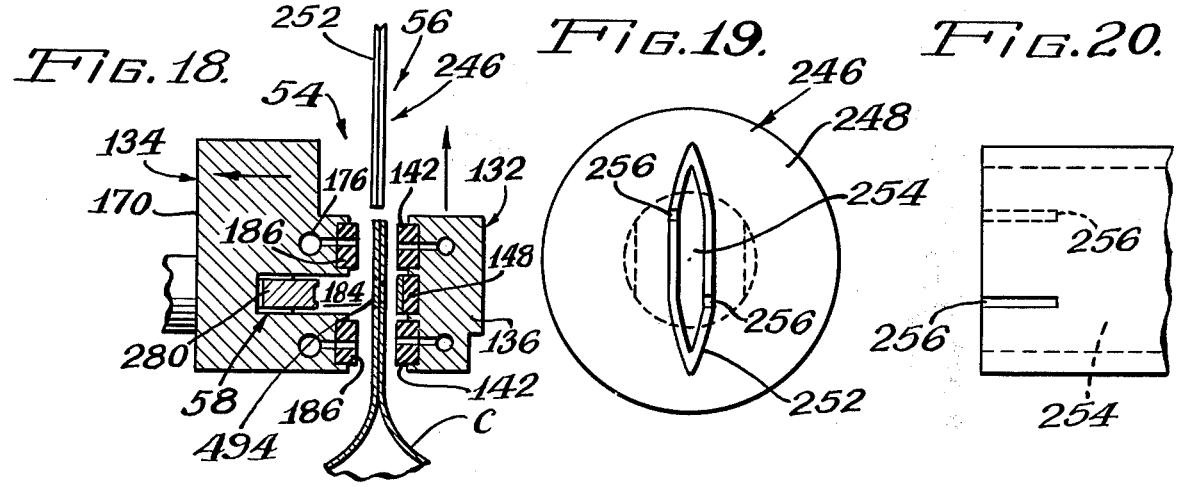
FIG.18.
FIG.19.
FIG.20.
252
56
246
54
134
170
176
142
132
186
184
148
136
280
58
494
C
256
254

392
394
322
420
390
416
334
332
300
418
438
439
432
434
412
424
406
436
428
430
336
426
306
352
348
356
350
324
354
342
370
364
394
340
346
394
366
360
362
340
304
308
326
344
D
M
M
M
M
B
310
302
382
380
386
388
372
376
384
374
378
326
386
382
372
376
378
384
380
374
326
D
320

402
400
392
400
402
322
398
390
398
420
396
420
418
418
416
416
320
300
412
404
306
384
410
406
412
384
304
324
408
338
408
422
316
314
410
316
D
318
422
M
M
M
B
M
M
302
310

PACKAGING APPARATUS

This is a continuation of Application Serial No. 364,305, filed May 29, 1973, now abandoned.

BACKGROUND OF THE INVENTION FIELD OF THE INVENTION and DESCRIPTION OF THE PRIOR ART This invention relates to an apparatus and process for packaging articles, particularly of the type which are adversely affected by oxygen, in substantially oxygen-free, gas containing flexible containers, and it more specifically relates to an apparatus and process for packaging fresh meat pieces, such as fresh red meat, in flexible containers wherein the meat may be held for extended periods of time without having the bacteria levels on or in the meat exceed acceptable limits and without having a significant adverse effect on the desired color of the fresh meat.

It is well known that there are a great number of materials that are adversely affected by the atmosphere, particularly humidity conditions and the oxygen therein. Such materials include metals, such as precious metals, which undesirably oxidize in air, and a great variety of food products, such as fresh fruits and vegetables, nuts, crackers, cured meats, fresh meats, including poultry, beef, pork, veal, and lamb, and like products.

In the case of food products, the oxygen and humidity conditions have undesired effects on the food. Particularly in the case of meat, the oxygen in the air supports the growth of bacteria on the surface of the meat, in particular, and the bacteria growth can increase to such a point that the meat becomes "spoiled" and/or the fat becomes rancid. There are many machines and processes known for packaging products, such as fresh and cured meats, in a wide variety of vacuumized, gas flushed, and/or sealed containers of various types. Canning, for example, is a well known technique for preserving food products. In order to preserve meat, various curing and preserving techniques have been used to preserve the meat over extended periods. Well known packaging techniques, primarily for consumer purchase include placing the products in flexible bags or containers. Also, vacuumizing the container to substantially eliminate bacteria growth supporting oxygen is well known. Gas flushing with preserving gases, as carbon dioxide, is also known. It is common to heat seal the thus vacuumized or gas flushed container containing sliced bacon, wieners, or the like. In essence, the preservation of foodstuffs, including fresh and cured meats, for extended periods of time is a well known and well developed art.

With particular emphasis on the preservation of fresh red meat, the storage problem has two stages. First, the meat must be properly preserved from the time the animal is processed and shipped from a packing plant to the ultimate user, such as a butcher shop or a restaurant. Although one preserving technique is to freeze the meat, probably most of the meat sold through butcher shops and consumed in restaurants is fresh meat, not previously frozen. Freezing is considered to have certain disadvantages in that the color and taste are often considered to be adversely affected by freezing. Additionally, freezing fresh meat is generally considered to be an expensive operation, requiring expensive freezing and storage equipment and also requiring considerable use of energy during freezing and during storage. Thus, meat which is shipped from a packing plant is more conventionally preserved, by refrigeration, at above freezing temperatures, as about 35°–50° F., until the food is prepared for serving, as in a restaurant, or until the meat is prepared for consumer purchase, as in a butcher shop.

Most of the meat shipped in bulk from a packing plant is preserved by refrigerating temperatures and not by absence of oxygen. The meat is preserved in this way so the bacteria level on or in the meat or poultry does not exceed levels which would be injurious to human health. Some of the injurious bacteria are aerobic, that is, air or oxygen is required for growth. The absence of oxygen, however, is generally considered to actually cause discoloration of fresh red meat product and this also is an undesirable result. Some reseachers have also considered that excessive concentrations of carbon dioxide cause greying or darkening of the meat, even after relatively short periods of time. Thus, fresh red meat presents two particularly difficult problems for packaging thereof, that is, excessive bacteria growth and meat discoloration.

The bacteria growth and discoloration problems are even more pronounced when retail butcher shops and restaurants "age" their meat for a sufficient period of time to permit the natural enzymes of beef to break down the cells or connective tissue until the beef is particularly tender and palatable. It is generally considered that such natural aging of beef for extended periods of time is highly preferable over artificial tenderization procedures, such as injection with various proteolytic enzymes. One significant problem with natural aging of beef is that the meat ordinarily, even under refrigeration, has considerable discoloration and bacteria or mold growth on the exposed surfaces of the meat. This is because the "aging" normally takes place in a refrigerated, oxygen-containing room or cooler, resulting in bacteria growth. Before the meat can be consumed, the butcher trims off not only the mold, but also a considerable portion of the meat adjacent the mold growth. As a result, there is a considerable loss in the amount of meat which can be consumed, as compared to the original cut. This leads to excessive prices for such meat for the consumer.

Although various techniques, including vacuum packaging, have been used at the retail level for preserving smaller amounts of meat, as for consumer packages of meat, bulk shipments of fresh poultry and meat have generally not involved vacuum packaging of the product. Generally, large bulk shipments of beef or pork have been in refrigerated vehicles. Some prior art has also suggested the inclusion of an atmosphere of gases, such as carbon dioxide, nitrogen, or the like. A significant disadvantage of maintaining a controlled gaseous atmosphere in a storage compartment, as in a butcher's cooler or in a vehicle, is that the controls for maintaining the compartment at the desired conditions of gas level, temperature, and humidity, for example, can be quite expensive and complex. Large pieces of fresh meat have also been packaged in vacuumized packages. For example, beef rib sections have been packaged in such a way. One quite well known system includes placing individual meat pieces into a flexible plastic bag, the bag is vacuumized and then a wire clip is placed around the gathered end of the bag. One of the disadvantages of this system is that, with the clipping arrangement, it is difficult to maintain a vacuum because the bag is only gathered and the vacuum is lost therethrough. Additionally, the system is principally adapted for packaging individual meat pieces and does not adapt to packaging of larger meat pieces or to bulk packaging a plurality of relatively large pieces of meat. In the case of vacuumized bags, the bag is generally taut and subject to splitting or breakage, thereby losing the vacuum and making the meat therein susceptible to undue bacteria growth.

The known equipment often requires some skill in operation. Such equipment also requires considerable floor space and usually requires a heated tunnel for shrinking the bag around the packaged product. Such heat tunnels are generally placed in a refrigerated room, causing additional undesirable expenses for maintaining the refrigerated room at the desired temperature, to offset heat from the heat tunnel, and at the same time, expenses are required for heating the heat tunnel to the desired level to offset the temperature of the refrigerated room. Also, in the separate packaging of individual meat pieces, there is a significant disadvantage in that labor expenses are high because each single piece requires a separate vacuumizing and sealing operation. Individual handling of each meat piece during packaging is clearly time and labor consuming and therefore undesirable.

SUMMARY OF THE INVENTION

It is therefore an important object of this invention to provide an improved apparatus and process for the packaging of articles in substantially oxygen-free packages, preferably containing gases which enhance the preservation of the articles being packaged.

It is also an object of this invention to provide an improved process and apparatus for packaging fresh red meat in such a way as to greatly enhance the shelf life thereof without significant adverse discoloration thereof.

It is a further important object of this invention to provide an improved packaging process and apparatus useful for the practice thereof wherein fresh red meat and/or poultry is bulk packed in a vacuumized flexible container containing suitable gases for retarding the growth of bacteria, avoiding undesirable discoloration, and enhancing the shelf life of the packaged meat.

It is yet another important object of this invention to provide an improved packaging process and apparatus for the practice thereof wherein fresh red meat, in particular, even after extended periods of time, has an extremely low bacteria level, far lower than acceptable standards, and yet the color of the meat is substantially unaffected by extended storage periods.

It is still a further object of this invention to provide an improved process and apparatus for the practice thereof wherein fresh beef is ultimately packaged in a flexible container substantially free of oxygen, and containing preserving gases, preferably carbon dioxide, wherein the bacteria level is low, the color is substantially unaffected and the tenderization in increased for extended periods of time.

It is still another important object of this invention to provide a process and apparatus for the packaging of fresh meat wherein trimming losses are negligible after the meat is naturally aged and thereby tenderized.

It is also another object of this invention to provide a unique process and apparatus for bulk packaging multiple pieces of meat in large, heat sealed, vacuumized, flexible containers located within supporting rigid outer containers wherein the packaged meat is maintained in a substantially oxygen free, controlled, meat preserving atmosphere.

It is yet another object of this invention to provide an improved apparatus for packaging meat for extended periods of time at above freezing, refrigerating temperatures, wherein the apparatus is characterized by requiring only a relatively small amount of floor space and yet has a high production capacity.

It is still a further object of this invention to provide a simplified apparatus for packaging meat for an extended shelf life wherein the apparatus is characterized by its simplicity in operation, requiring little skill from the operator.

It is yet a further object of the invention to provide an improved packaging process for eliminating excessive costs and disadvantages of packaging articles in individual containers by bulk packaging such articles, thereby effecting significant labor savings.

It is still another object of this invention to provide a meat packaging apparatus and process wherein no energy is required for freezing the meat or for heating the package during processing.

It is also a further object of this invention to provide a meat package which preserves meat for extended periods of time without undue bacteria growth and without adverse effect on the color of the stored meat, particularly red beef.

It is still a further object of this invention to provide apparatus for packaging a variety of articles in a flexible container wherein the apparatus is characterized by a plurality of individually unique and highly effective mechanisms which cooperate to provide a highly unique packaging machine.

Further purposes and objects of this invention will appear as the specification proceeds.

The foregoing objects are accomplished by providing a process and apparatus for packaging articles, particularly, fresh meat pieces, in a substantially gas impermeable container having an open end. The apparatus includes a frame for supporting the flexible container within a rigid outer container, the articles being packaged being contained within the flexible container. A vacuum manifold is provided for releasably gripping the open end of the container on opposite sides thereof. Tubular or hollow members, defining passage means, are provided and controls are provided for inserting the passage defining tubular members into and out of the flexible container. After the tubular members are inserted into the container, the flexible container is sealed temporarily, along the gripping means, along its open end, while the passage means are in the container. Control means are provided for vacuumizing the container and thereafter adding an oxygen-free, preserving gas preferably carbon dioxide, thereinto through the passage means while the container is being temporarily sealed. Particularly, in the case of fresh beef products, the carbon dioxide concentration is such as to avoid meat discoloration. Means are provided for removing the passage means, after vacuumizing and after adding gas, without breaking the seal. After the passage means are removed from the flexible container, the container is permanently sealed, as by heat sealing, along the open end of the flexible container.

BRIEF DESCRIPTION OF THE DRAWINGS

Particular embodiments of the present invention are illustrated in the accompanying drawings wherein:

FIG. 12 is a detailed, fragmentary view showing the start position, before commencing the vacuumizing, gas filling and sealing of the flexible container used in our packaging process;

FIG. 13 is a view similar to FIG. 12, showing the front manifold in the lowered position;

FIG. 14 is a view similar to FIGS. 12 and 13, with the rear manifold moved into the forward position for grasping the open upper end of the container;

FIG. 15 illustrates the next step in the sequencing operation of the apparatus wherein the rear manifold is moved rearwardly and the passage defining or snorkel means are inserted into the flexible container;

FIG. 16 is a view, similar to FIGS. 12–15, wherein the front and rear manifolds temporarily seal the upper end of the flexible container as the passage defining means is inserted into the flexible container for vacuumizing and adding gas to the flexible container;

FIG. 17 is a view, similar to FIGS. 12–16, again showing the next operating step, wherein the passage defining or snorkel means are removed from the flexible container, following vacuumizing and addition of gas, and during the heat sealing of the flexible container;

FIG. 18 is a view, similar to FIGS. 12–17 following the heat sealing and showing completion of the sequencing of the apparatus and thereby completion of the packaging operation;

FIG. 19 is an end view of the snorkel or passage means used for vacuumizing and adding gas to the flexible container;

FIG. 20 is a fragmentary end view of the embodiment of FIG. 19;

DETAILED DESCRIPTION OF THE PREFERRED EMBODIMENTS

Figures 1, 2:
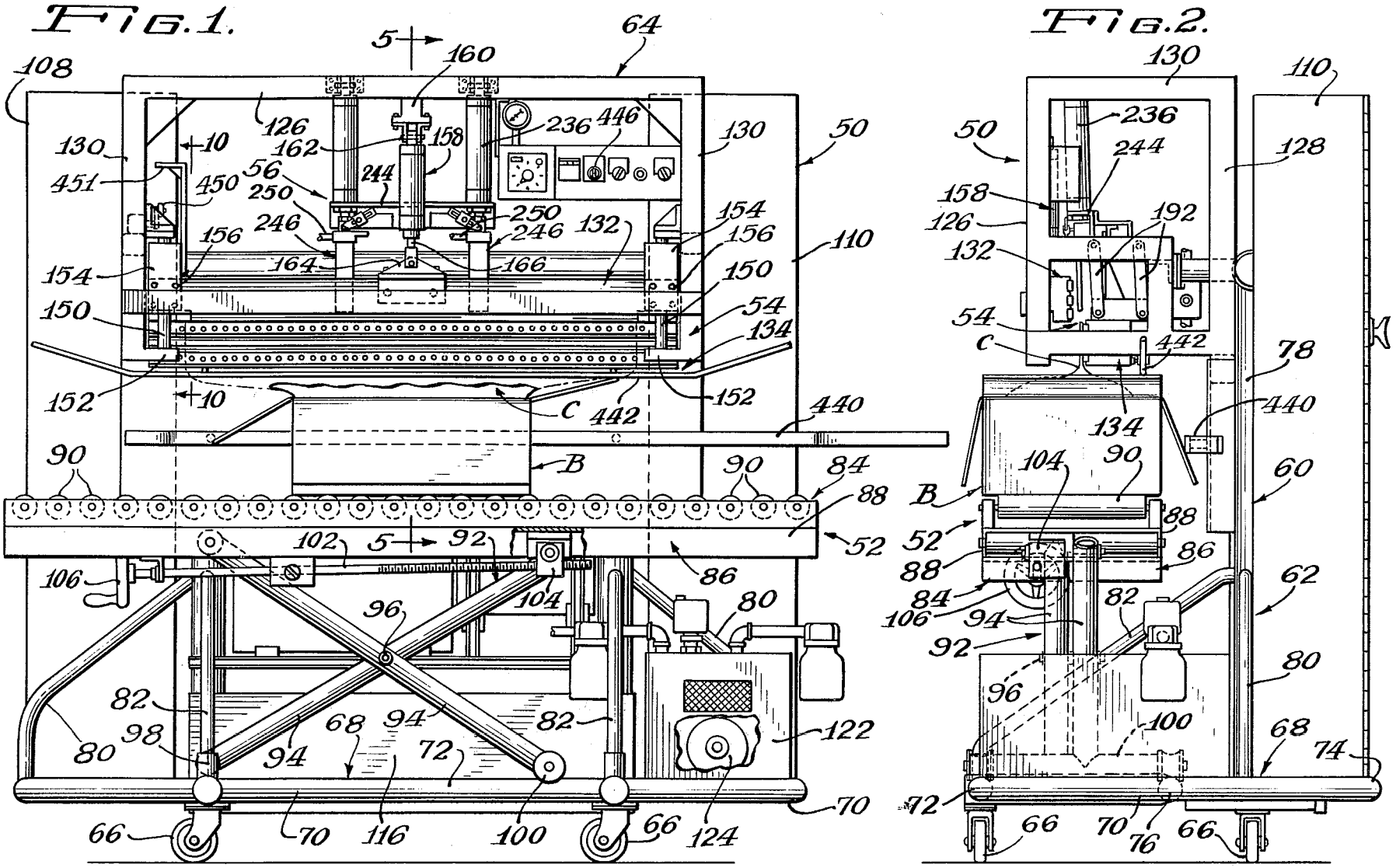
FIG. 1 is a front elevational view of one preferred embodiment of apparatus useful for practicing our novel packaging process.
FIG. 2 is an elevational view of one end of the embodiment of FIG. 1.
Figure 4:
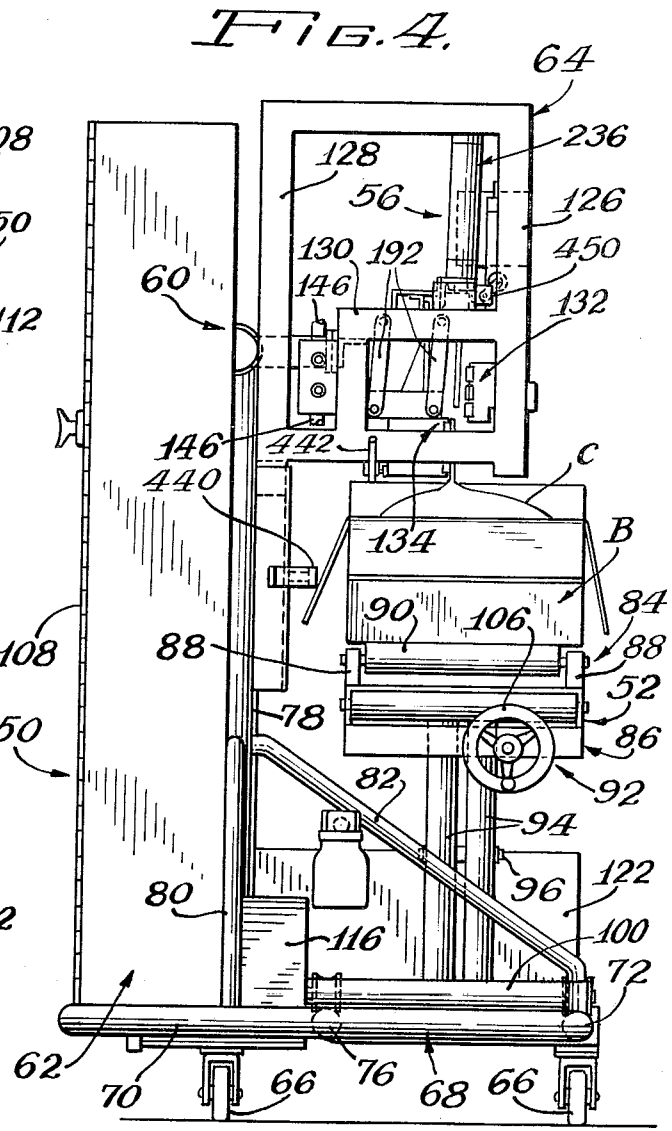
FIG. 4 is an elevational view of the other end of the embodiment of FIGS. 1 and 3.

Referring to FIGS. 1 – 20, one preferred apparatus, generally 50, useful for practicing our packaging process is shown. The apparatus 50 generally includes a package support frame, generally 52, a bag gripping assembly, generally 54, a vacuumizing and gas adding assembly, generally 56, and a heat sealing assembly, generally 58. The apparatus 50 may be used for packaging a large variety of articles, particularly those articles which are commonly adversely affected by the atmosphere, such as metals, including precious metals, fruits, vegetables, nuts, crackers, cookies, bread, and the like, because of, for example, humidity conditions and oxygen. For purposes of simplicity, it is to be understood that our process and the apparatus 50, described herein, useful for practicing our process, will specifically describe the packaging of fresh meats, such as fresh poultry, fresh veal, fresh pork, fresh lamb and fresh beef, such packaging being one of the principal and most important uses of our process and apparatus. More specifically, the description will hereinafter generally refer to the packaging and processing of fresh cut beef. Also although the invention here in is particularly useful for bulk packaging a plurality of meat pieces, in a single package or container, it is to be understood that the apparatus and process is also very useful for the packaging of single articles, such as large pieces of beef, as block beef, in a single container.

Figure 5:
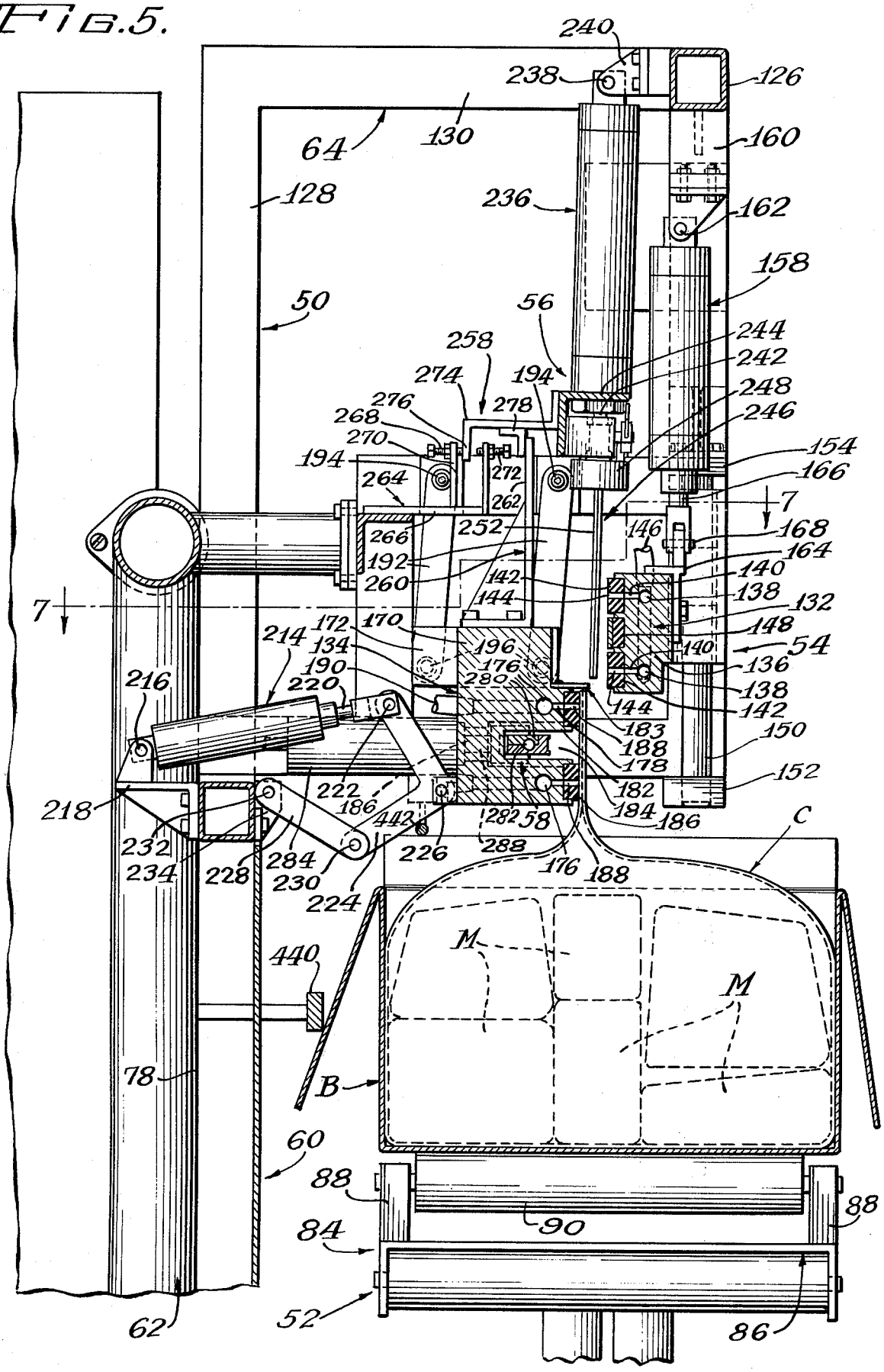
FIG. 5 is an enlarged, partially sectioned view showing the apparatus of FIGS. 1 – 4, prior to the time that the flexible container, used in our process, is vacuumized and sealed.
Figure 6:
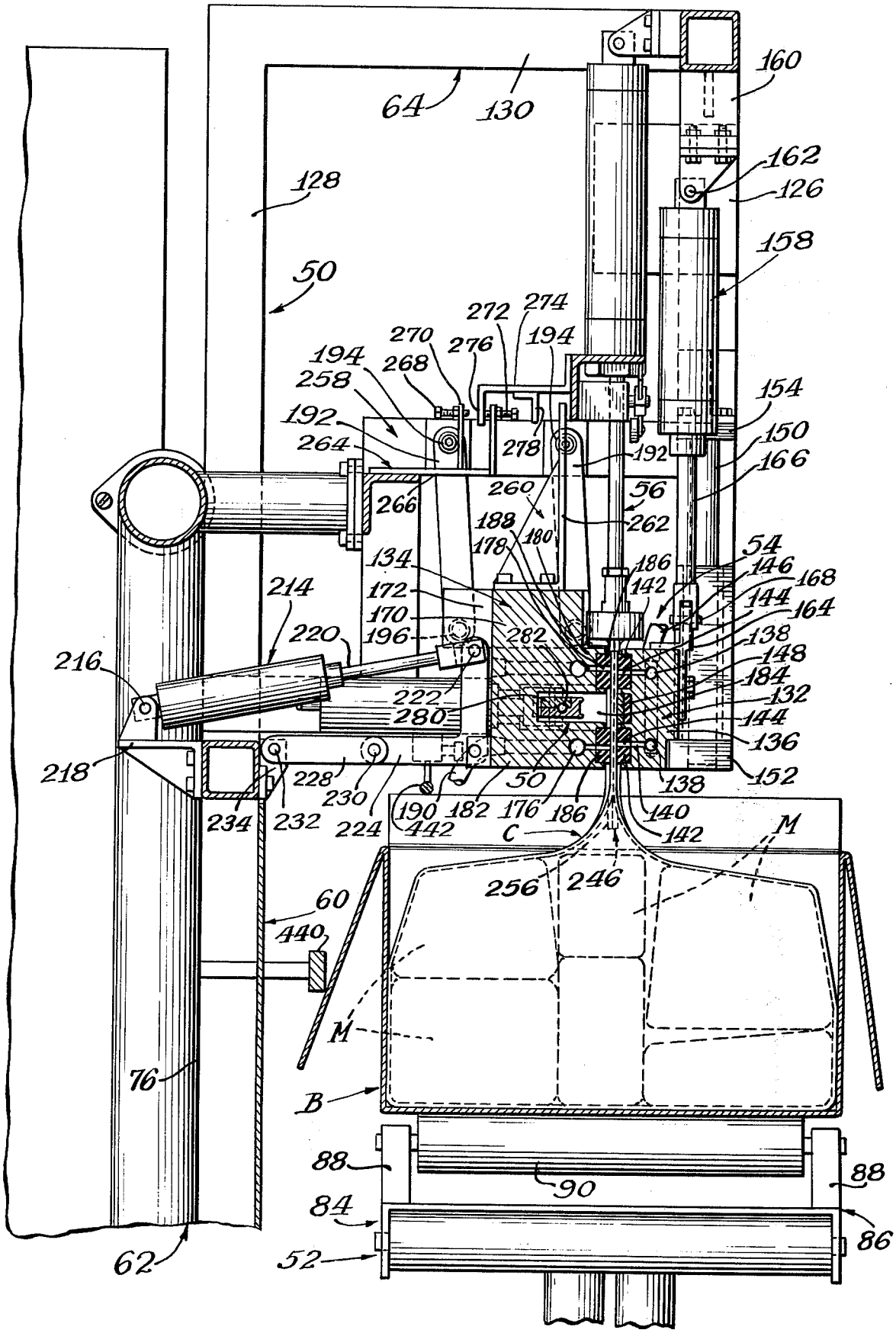
FIG. 6 is a view similar to FIG. 5 with the passage defining means positioned within the flexible container for vacuumizing and addition of gas thereto.

In the packaging of meat pieces M, as seen in FIGS. 5 and 6, for example, the meat M is contained within a flexible container C. In turn, the flexible container C is contained within a self supporting, rigid outer container or corrugated box B. The structure of the flexible container C is considered important in the process, and certain requirements, particularly for the packaging of fresh red meat, are called for. Although a variety of low gas permeable, heat sealable flexible containers are useful in our process, one preferred bag or flexible container C comprises a laminated, flexible, substantially flat, double paneled, plastic container, having an open upper end and three heat sealed sides. The lamination of each panel comprises nylon bonded to Surlyn (DuPont trademark), such a lamination being widely used in the meat industry for storage of meat. This material has the desirable property of low air or gas permeability and is also heat sealable regardless of the presence of blood or fat at the heat seal area. In this lamination, the nylon layer is on the exterior and the Surlyn layer is on the interior so that the heat seal is between the abutting surfaces of the Surlyn panels. In one specific example of this product, the nylon layer has a thickness of about 0.0177 inches and the thickness of the Surlyn layer is in the range of 2 to 4 mils.

Another flexible container which has been found to be quite satisfactory is sold under the trademark Maraflex Z 284-400 Freshtuff Primal Meat Bag. This product is available from the American Can Company. The oxygen barrier properties of the material are approximately 5 – 8 milliliters/meter squared for 24 hours at 73° F. and 50 percent relative humidity. The water permeability rate is approximately 2.5 grams per meter squared for twenty-four hours at 100° F. and 90 percent relative humidity. Containers made from this product are also heat sealable, even in the presence of fat or blood. A bag having a flat dimension of about 32 inches × 41 inches has been found to be suitable for packaging about 50 – 80 pounds for fresh meat. The size of the bag is, of course, variable over a wide range.

The container B is desirably made from a conventional collapsible corrugated box of a selected size. One of the advantages of our process is that, with the use of the flexible containers C, the box B does not require any special interior coating. This is in contrast to prior art corrugated containers which have been used for shipping and storage of meat cuts wherein a coated interior was required and also such containers were not reuseable. Since the flexible container C is in contact with the meat in the applicant's invention, the box B not only does not need an internal moisture-proof coating, but it is also possible to reuse the box B because the meat does not contact the interior. Avoidance of the interior coating and ability to reuse represent a considerable saving over the meat packaging techniques using coated containers.

Referring to FIGS. 1 – 4, the apparatus 50 includes a main frame, generally 60, located above, below and to the rear of the package frame section 52. The frame 60 supports the package frame 52, the bag gripping section 54, the vacuum assembly 56, and the heat sealing assembly 58. The frame 60 includes a rear cabinet or frame, generally 62, and an overhead frame assembly, generally 64. The apparatus 50 is movably supported by four caster wheels 66 mounted on the lower or base portion of the frame 60.

The main frame 60 includes a welded base portion 68 which is constructed of hollow tubular frame members formed in a generally rectangular shape. The frame base 68 includes a pair of end pieces 70 and spaced front and rear sections 72 and 74. An intermediate tubular frame section 76 is positioned substantially parallel and intermediate the frame section 72 and 74, with the opposite ends of the frame section 76 rigidly secured, as by welding, to the inner faces of the opposite frame ends 70. The main frame 60 includes an upright frame section 78 which extends upwardly from and is fixed to the base 68 and provides rigid support for the overhead frame section 64, as well as for the rear frame section or cabinet 62. The base 68 also includes a pair of longitudinal, spaced end frame sections 80 which project upwardly from the base 68 and rigidly interconnect with the upright section 78. A pair of spaced, frontwardly projecting transverse frame sections 82 also project upwardly from the base 68 and interconnect with the upright frame sections 78. The frame sections 80 and 82 assist in rigidly supporting the upright frame section 78 and thereby the overhead frame 64 in a substantially rigid or fixed condition.

The package frame 52 is vertically movable relative to the main frame 60. The box B containing the meat M is supported on the package frame 52 and specifically rests on a longitudinally positioned roller conveyor assembly 84. The conveyor assembly 84 includes a longitudinally elongated frame 86 having side members 88 which rotatably carry a plurality of transversely positioned roller members 90 which support the box B and its contents.

The vertical level of the conveyor frame 86 is adjustable by an adjusting assembly, generally 92. The assembly 92 includes a pair of crossing members 94 which are pivotally interconnected at 96. The upper end of one cross member 94 is pivotally connected to the upper portion of one side 88 of the conveyor frame 86 while the lower end of the other cross member 94 is pivotally interconnected to the base 68 at 98. The lower end of the cross member 94 which is pivotally connected to the side 88 of the frame 86 includes a transverse support 100 which is slidably mounted on the upper portions of the front frame section 72 and of the intermediate frame section 76 of the base 68. A longitudinally elongated threaded member 102 is rotatably mounted on the underside of the frame 86. A threaded nut 104 threadably engages the threaded member 102. The upper end of the cross member 94, which is pivoted to the base 68, is also pivotally connected to the nut 104. A handle 106 is rigidly secured to the threaded member 102. When the handle 106 is rotated, the non-rotatably mounted thread member 104 is longitudinally and selectively moved in forward or reverse directions along the elongated threaded member 102. With this movement, the crossing members 94 create a scissors type of action to vertically raise or lower the conveyor assembly 84 to the desired level.

Figure 3:
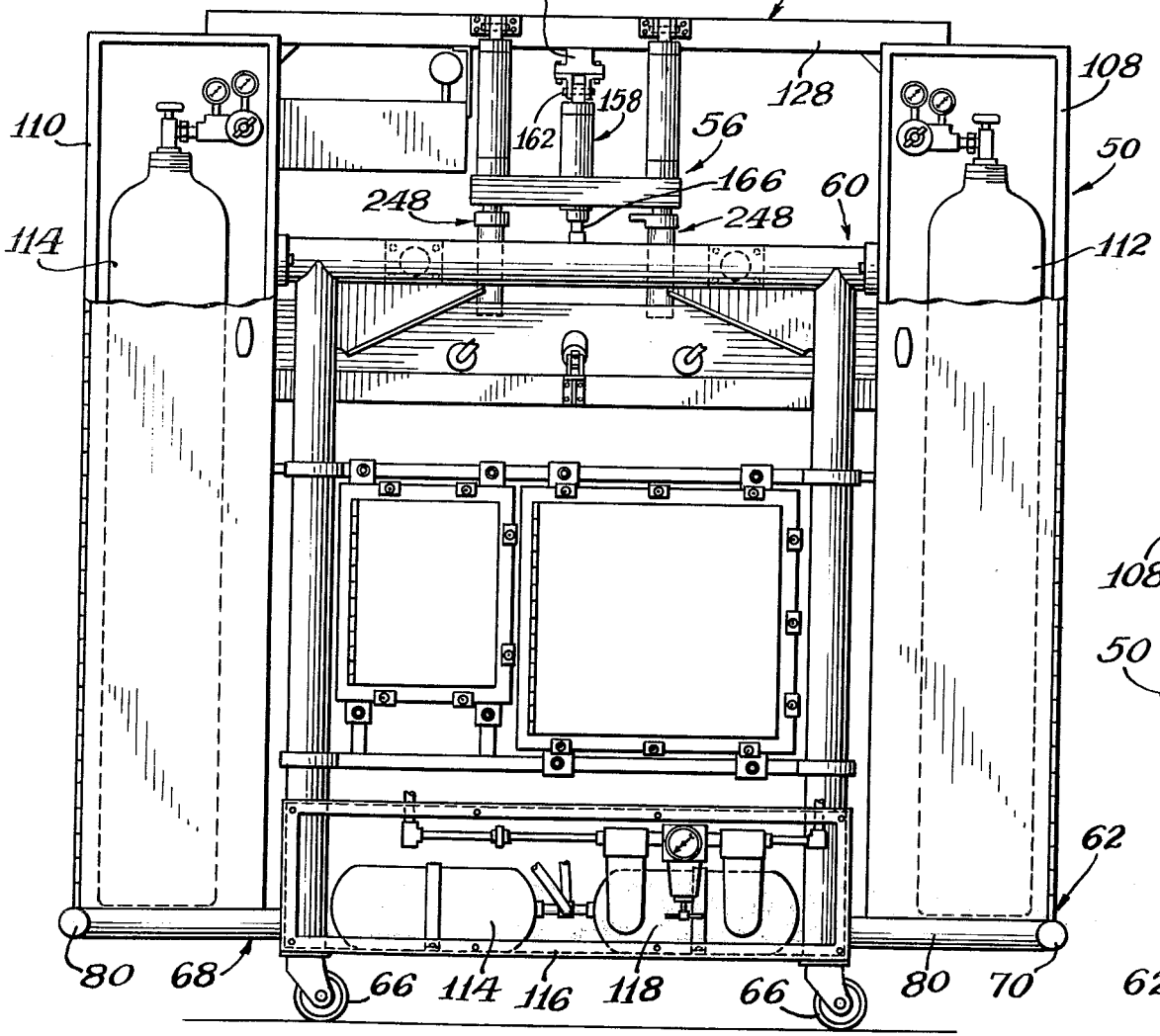
FIG. 3 is a rear elevational view of the apparatus of FIG. 1.

Referring particularly to FIG. 3, the rear frame section or cabinet 62 is rigidly interconnected to the main upright frame section 78. The rear frame section 62 includes a pair of upright, side cabinets 108 and 110 for enclosing a pressurized carbon dioxide tank 112, on one side of the frame 60, and a pressurized nitrogen tank 114, on the opposite side of the frame 60. An intermediate lower cabinet 116 contains a pair of pressure accumulators 118 and 120 on opposite sides. One accumulator 118 is for accumulating pressurized carbon dioxide therein and the other accumulator 120 is for storing pressurized nitrogen therein. The purpose of the carbon dioxide tank 112 and accumulator 118 as well as the purpose of the nitrogen tank 114 and nitrogen accumulator 120 will be hereinafter described in greater detail.

The base 68 also supports a laterally positioned lower cabinet 122 which contains a vacuum pump 124. The purpose and operation of the vacuum pump 124 will also be hereinafter described in greater detail. Again, referring in particular to FIGS. 1 – 4, the overhead frame assembly 64 is generally positioned over the conveyor assembly 84 and over the base 68. The open space between the conveyor assembly 84 and the overhead frame 64 is provided for receiving the box B with its contents therein. This basic geometry of the apparatus 50 is important in packaging articles in large quantities in relatively heavy packages as it supports such packages in a position suitable for vacuumizing and/or gas addition, and heat sealing operations performed by the apparatus.

The overhead frame 64 generally includes a front welded frame section 126, a rear welded frame section 128, and a pair of opposed side welded frame sections 130. The frame sections 126, 128 and 130 are each comprised of a plurality of longitudinal, transverse, and upright frame members which are welded together to form the rigid overhead support frame 64.

The various frames and cabinets, as shown and described, in the case of meat processing are constructed of stainless steel panels and frame members so as to be readily washed down after use. Similarly, all motors, electric controls, and the like, are waterproof or splash proof for the same reasons.

Figure 7:
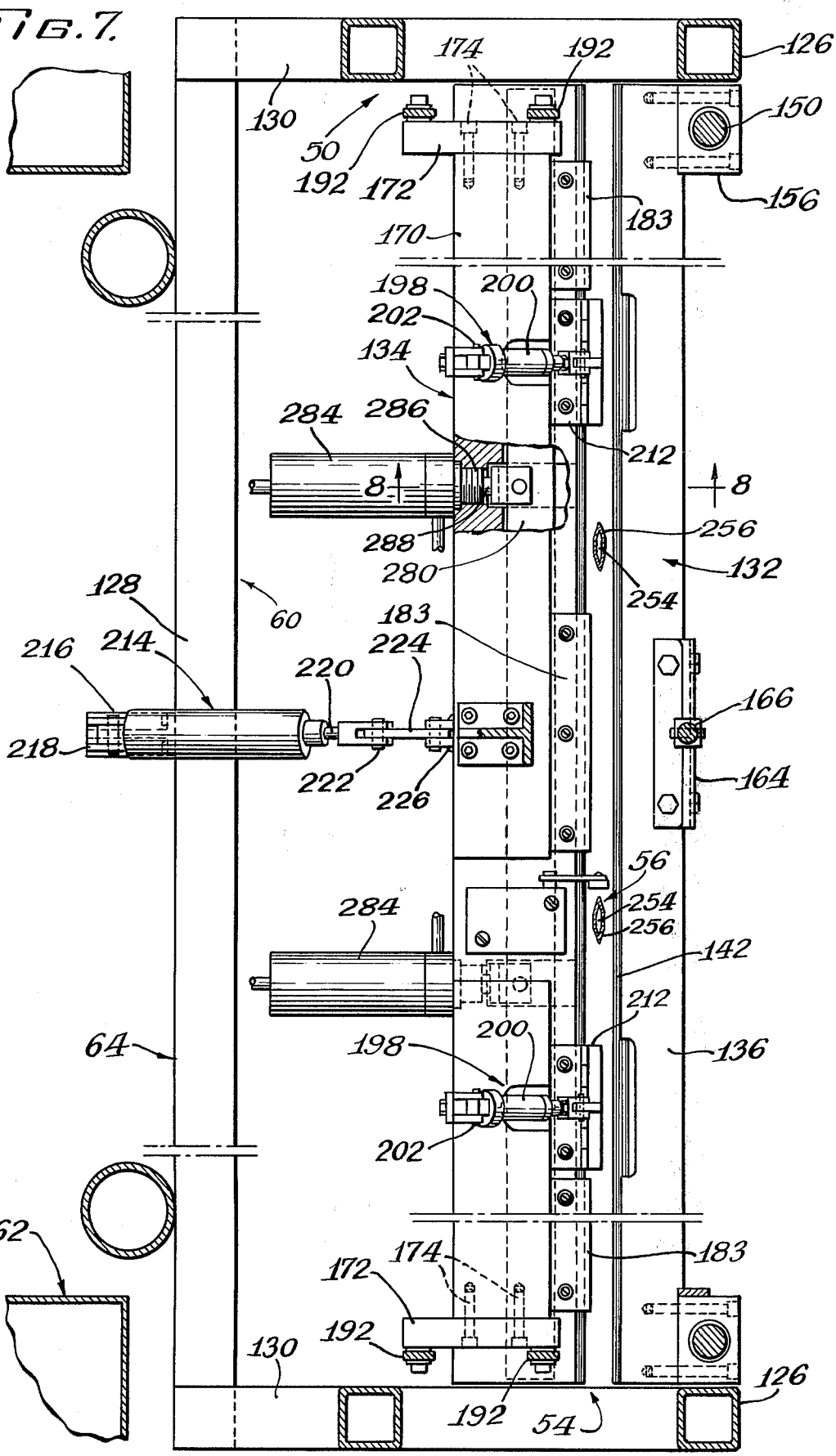
FIG. 7 is a partially broken, sectional view taken along the line 7—7 of FIG. 5, particularly showing the manifold members used for holding the open end of the flexible container.

Referring particularly to FIGS. 5, 6 and 7, the bag gripping section 54 is shown most clearly. The bag gripping section 54 includes an elongated front manifold, generally 132, and an elongated rear manifold, generally 134, which cooperates with the front manifold 132 to hold the open upper end of the flexible container C in the desired position during the vacuumizing, gas filling, and heat sealing of the flexible container C. Both the front manifold 132 and the rear manifold 134 are substantially parallel with each other and have their longitudinal axes aligned with the longitudinal axis of the machine 50 itself. The front manifold 132 is movable in a substantially vertical direction while the rear manifold 134 is movable in a substantially horizontal direction in a manner to be hereinafter described.

The front manifold 132 includes an elonagated, rigid support section 136 having longitudinal, interconnected passageways 138 located internally and extending for the entire internal length thereof. Passageways 138 interconnect with each of a plurality of inwardly facing openings 140 which extend substantially along the upper and lower portions of the inwardly facing wall of the elongated support section 136 of the front manifold 132. The upper and lower walls of the openings 140 are vertically spaced from each other and are substantially parallel with each other. The inwardly facing wall of the front manifold 132 has elongated upper and lower flexible sealing pads 142 adhesively, but replaceably bonded thereto. The pads 142 each include pad openings 144 which are in substantial alignment with the openings 140 in the metal support section 136. The openings 140 in the support section 136, the pad openings 144, and the passageways 138 define a manifold which interconnects with a flexible hose 146 which selectively communicates with a vacuum from the vacuum pump 124.

Intermediate the pads 142, there is provided an elongated, flexible heat seal back-up pad 148 which, like the pads 142, is adhesively but replaceably bonded to the inwardly facing wall of the front manifold 132. The back up pad 148 is flexible to substantially the same degree as the sealing pads 142. The purpose of the flexibility for the back up pad 148 and for the sealing pads 142 will be described hereinafter in greater detail.

The front manifold 132 is movably supported in a horizontal position and for vertical movement by a pair of laterally spaced, fixed, upright guide rods 150 which are rigidly mounted to the front portion 126 of the overhead frame 64. Each of the guide rods 150 is rigidly held in a vertical position by spaced lower and upper supports 154. As seen best, for example, in FIG. 8, a support assembly 156 is rigidly secured to the front face or front wall at each end of the front manifold 132 and is slidably received by each of the guide rods 150 to thereby guidably support the front manifold 132, in a substantially horizontal position, for vertical, reciprocal movement. Each bearing support 156 preferably uses two ball bushings to better assure the appropriate level movement of the manifold 132. Ball bushings, sold under the trademark Thompson, have been found to be particularly satisfactory.

The vertical, reciprocal movement is imparted to the front manifold 132 by an air cylinder assembly, generally 158. The air cylinder assembly 158 is secured at its cylinder end to a support bracket 160 which is fixedly secured to the front portion of the overhead frame 64, as seen best in FIGS. 1 and 7. Because of slight angular out of vertical movement of the cylinder assembly 158 during operation thereof, a pivot connection 162, is provided between the assembly 158 and the bracket 160. A support member 164 is rigidly mounted centrally of the front portion of the front manifold 132 and a piston rod 166 of the air cylinder assembly 158 is pivotally secured thereto by a pin 168 to permit slight relative movement therebetween. At the appropriate signal, to be hereinafter described, the air cylinder 158 is activated by air pressure to selectively reciprocate the front manifold 132 downwardly or upwardly, as needed.

The rear manifold 134, as disclosed previously, is selectively reciprocally movable forwardly and rearwardly. The rear manifold 134 includes an elongated, rigid support section 170 which is substantially parallel and alignable with the front manifold 132. The opposite ends of the support section 170 include support brackets 172, as seen best in FIGS. 5 – 7, rigidly mounted thereon. The support brackets 172 are rigidly secured to the outer faces of the support section 170 by bolts 174. The support section includes internal passageways 176 which extend for substantially the entire length of the support section 170. The passageways 176 interconnect with a plurality of frontwardly opening openings 178, which extend through the spaced upper portion 180 and lower portion 182 of the elongated support section 170. A hollow space 184 is defined between the spaced upper and lower sections 180 and 182.

Upper and lower pads 186 are adhesively, but replaceably bonded to the outer face of the elongated support section 170 and are constructed of the same flexible material and in a manner similar to the flexible pads 142 which are similarly bonded to the front manifold 132. The pads 142 and 186 are made of foamed rubber. The pads 186 are bonded to both the upper and lower sections 180 and 182. Pad openings 188 are provided in the pads 186 and are in alignment with the openings 178 in the support section 172. The pad openings 188, the openings 178, and the passageway 176 define a manifold which interconnects with a flexible hose 190 which selectively interconnects to the vacuum pump 124. In order that the manifolds 132 and 134 properly grip the flexible bag C, the pad openings 188 are laterally and vertically offset from the pad openings in the front manifold.

The rear manifold 134 is mounted for substantially horizontal movement by two pairs of spaced pivot arms 192 which are pivotally secured to each of the end support brackets 172. The lower ends of the arms 192 are each pivotally secured at 196 to the brackets 172, while the upper ends of the arms 192 are pivotally secured at 194 to transverse side sections 130 of the overhead frame 64. With this support arrangement, the rear manifold 134 is movably supported in forward and reverse directions, while the outer faces of the upper and lower pads 186 remain in a substantially vertical or upright position so as to properly align with the front manifold 132 to grip a flexible container C, as will be hereinafter described.

Referring to FIG. 6, when the front manifold 132 is in the lowered position, and when the rear manifold 134 is in the forward position, the manifolds 132 and 134 cooperate to positively hold the open upper end of the flexible container C in a closed position. The manner of accomplishing this will be described hereinafter in greater detail. Vacuum is selectively applied by the vacuum pump 124 to the openings 188 in the rear manifold 134, the bag or container C being held in place initially by such vacuum. More specifically, the side of the container C adjacent the rear manifold 134 is initially held in place against the pad openings 188 by vacuum in the manifold 134. In order to positively hold the front panel of the container C, after manual positioning and after the rear panel is held by vacuum against the rear manifold 134, referring to FIGS. 8 and 9, a mechanical bag clamp, generally 198 is provided for positively gripping the upper ends of both panels of the flexible container C against the upper pad 186 of the rear manifold 134.

Figure 8:
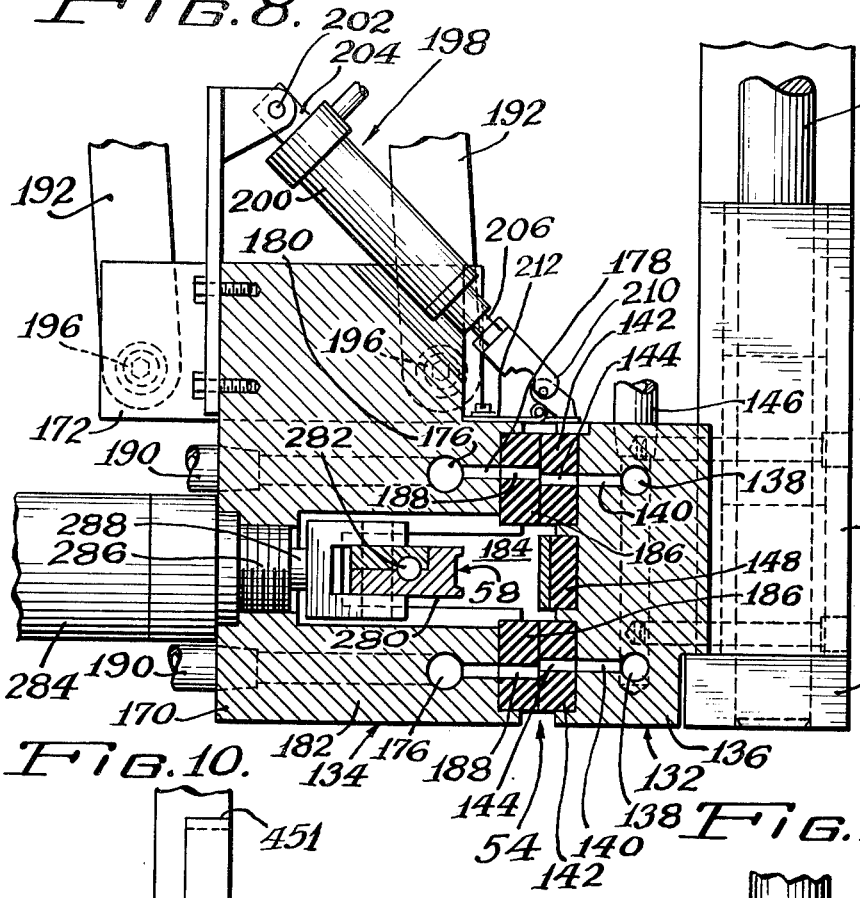
FIG. 8 is an enlarged sectional view taken along the line 8—8 of FIG. 7, showing the flexible container holding means in a closed position and with mechanical bag clamping means shown in the inoperative position.
Figure 9:
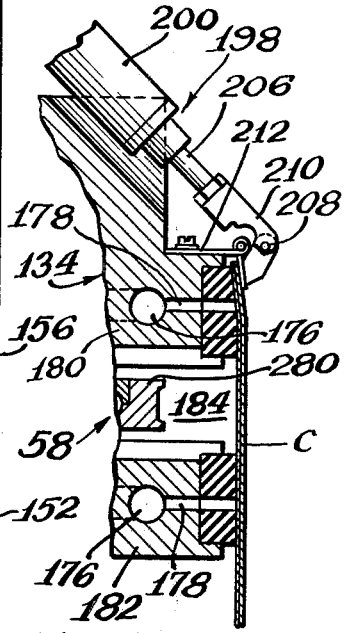
FIG. 9 is a fragmentary, detailed view showing the bag clamping means in the operative position.

The bag clamp assembly 198 includes an air cylinder assembly 200 which is pivotally secured by a pivot member 202 to a support arm 204. The support arm 204 is rigidly secured to the support section 170 of the rear manifold 134. A piston rod 206 of the air cylinder 200 is pivotally connected at 208 to an arm 210 which, in turn, is rigidly secured to one half of a hinge clamp 212. The other half of the hinge clamp 212 is rigidly secured to the support section 170, as best seen in FIGS. 8 and 9. When the air cylinder 200 is activated, the rod 206 moves from the position of FIG. 8 to that of FIG. 9 so as to pivot the hinge clamp 212 to the position of FIG. 9, and positively hold both sides of the upper end of the container C against the pad 186 until such time as the rear manifold 134 and front manifold 132 move into proximate relationship, as shown in FIG. 6.

It is also important, as seen best in FIG. 8, that in the closed position, the passage or openings 140 in the front manifold 132 are to be offset, as discussed above, from the openings 188 in the rear manifold 134 so that the vacuum applied against the opposite panels of the upper end of the container C are not in direct opposition. If the passages or openings 140 and 170 are in direct alignment, the front panel of the bag or container C is not under the proper influence of the vacuum in the front manifold 132.

Referring to FIGS. 5 and 6, the desired forward and reverse movement is imparted to the rear manifold 134 by an air cylinder assembly 214. The cylinder end of the cylinder assembly 214 is pivotally secured at 216 to a bracket 218 which is rigidly secured, as seen in FIG. 7, to the central portion of a longitudinal frame member of the rear section 128 of the overhead frame assembly 64. The piston rod 220 of the cylinder assembly 214 is pivotally secured at a pivot pin 222 to a crank arm 224. The crank arm 224 is, at its central portion, pivotally secured to a bracket 226 which is fixedly secured to the rear of the rear manifold 134. The lower end of the crank arm 224 is pivoted to a link 228 at a pivot connection 230. The link 228, in turn, is pivotally secured at 232 to a bracket 234 which is fixed to the central portion of the same frame member which carries the bracket 218. As seen in FIG. 6, when the air cylinder assembly 214 is activated, the piston rod 220 moves outwardly and pivots the crank arm 224, thereby moving the rear manifold 134 to the full forward position for positively gripping the open upper end of the flexible container C in a fixed position between the manifolds for the operation of the machine 50. The link 228, in the position shown in FIG. 6 is in axial alignment with the lower section of the arm 224 to thereby act as a clamp to positively clamp the rear manifold 134 in the full forward position against the front manifold 132.

As seen best in FIG. 6, the vacuumizing and gas adding assembly 56 is inserted into the flexible container C for the desired vacuumizing thereof and gas addition thereto. The assembly 56 is best shown in FIGS. 1 and 5–7, and includes a pair of laterally spaced, upright air cylinder assemblies 236. Each of the air cylinder assemblies 236 is of substantially the same construction, so reference will generally be made to only one of the air cylinder assemblies 236. Each air cylinder assembly 236 is pivotally secured at 238 to a support bracket 240 which is rigidly secured to the inner face of the front frame section 126 of the overhead frame 64. Each of the cylinder assemblies 236 is located substantially equidistantly from the upright, central axis of the apparatus, as seen best in FIG. 1. Each cylinder assembly 236 includes a downwardly extending piston rod 242. The lower end of each cylinder wall of the air cylinder 236 is rigidly interconnected to an angle member 244, to interconnect to the lower ends of each of the cylinder assemblies 236.

Each end of each piston rod member 242 is rigidly connected to a hollow snorkel member 246. Each snorkel member 246 includes an enlarged upper flange 248 having a passageway (not shown) therein interconnected to a flexible hose 250, which selectively interconnects, by suitable valves, to a vacuum or to a gas, as will be hereinafter described. A downwardly extending, elongated, substantially flattened hollow member 252 projects downwardly from the flange 248 and a passasgeway 254 is defined therein. The passageway 254 interconnects with the passageway in the flange 248.

Referring particularly to FIGS. 19 and 20, the passageway 254 terminates with an open bottom and substantially longitudinal upright slots 256 adjacent the open bottom. The air cylinder assembly 236 is constructed to permit at least the open bottom portions of the hollow members 252, including the slots 256, to project into the interior of the flexible container C so as to properly draw a vacuum therefrom or to add the desired gas thereto.

In order to properly aling each snorkel assembly 246 within the flexible container C and between the gripping manifolds 132 and 134, a snorkel positioning assembly, generally 258, is provided. The positioning assembly 258 includes a rigid stopl member 260 having an upwardly projecting flange 262, the stop 260 being rigidly secured to the upper face of the rear manifold 134. The positioning assembly 258 further includes an adjustable stop member 260 which is rigidly secured to the overhead frame 64 which projects forwardly therefrom. A forwardly projecting flange 266 has an adjustable threaded stop 268 on a rear upright flange 270 and an adjustable threaded stop 272 on a front upright flange. The angle member 244, secured to the air cylinder assembly 236, has a support 274 mounted thereon. The support 274 has a rear downwardly projecting flange 276 and a front downwardly projecting flange 278 spaced from the rear flange 276. The rear flange 276 is positioned intermediate the threaded stops 268 and 272.

As best seen in FIG. 5, when the rear manifold 134 is in the full back position, the rear flange 276 on the support 274, secured to the air cylinder assembly 236, engages the rear stop 270. When the rear manifold 134 is moved to the full forward position, as seen best in FIG. 6, the flange 262 of the stop 260 moves away from engagement with the front flange 278, and the rear flange 276 on the support 274 engages the front threaded stop 268 so as to properly align the snorkel assembly 246 above the open upper end of the flexible container C and intermediate the manifolds 132 and 134. The air cylinder assembly 236 moves forwardly, as the flange 262 on the rear manifold 134 engages the angle member 244 to push the vacuumizing assembly 56 to the forward position. The positioning assembly 258 assures that the snorkels 246, which pivot about the pivot point 238, are properly positioned at all times relative to the substantially horizontally movable rear manifold, particularly for insertion into the flexible container C.

Referring to FIGS. 5 – 7, the heat sealing assembly 58 includes a heating member comprising a tubular heating rod 282 positioned centrally therein. The heat bar 280, preferably of aluminum of heat transfer purposes, is movable from a rear position, as shown in FIG. 5, within the hollow portion 184 of the rear manifold 134 to a full forward, heat sealing position as seen in FIG. 17. The heat seal bar 280 is then in alignment with the heat seal back up pad 148 positioned on the front manifold 132.

The heat seal bar 280 is movable relative to the rear manifold 134 by a pair of air cylinder members 284. Each of the air cylinder 284 is rigidly mounted, as best seen in FIG. 7, on the rear wall of the rear manifold 128. Preferably, a threaded connection 286 is provided therebetween. Moveable piston rods 288 are rigidly interconnected at spaced positions to the heat seal member 280.

Each of the cylinders 284 is positioned substantially equidistantly on opposite sides of the central upright axis of the apparatus 50, as best seen in FIG. 7. When air pressure is applied to the cylinders 284, the heat bar 280 selectively moves forwardly or rearwardly to or from the heat sealing operation, as will be described hereinafter in greater detail. When in the full forward, heat sealing position, the rear manifold 134 through the link 228 and arm 224, is clamped against the manifold 134 to offset the force of the air cylinders 284.

Apparatus 300 embodied in FIGS. 22–28 is of similar construction to that of the apparatus 50 of FIGS. 1 – 20. The apparatus 300, like the apparatus 50, includes a package support frame, generally 302, a bag gripping section, generally 304, a vacuumizing and gas adding assembly, generally 306, and a heat sealing assembly, generally 308. The apparatus 300 includes several preferred structural and operative advantages to be hereinafter described.

Figures 22, 23, 24:
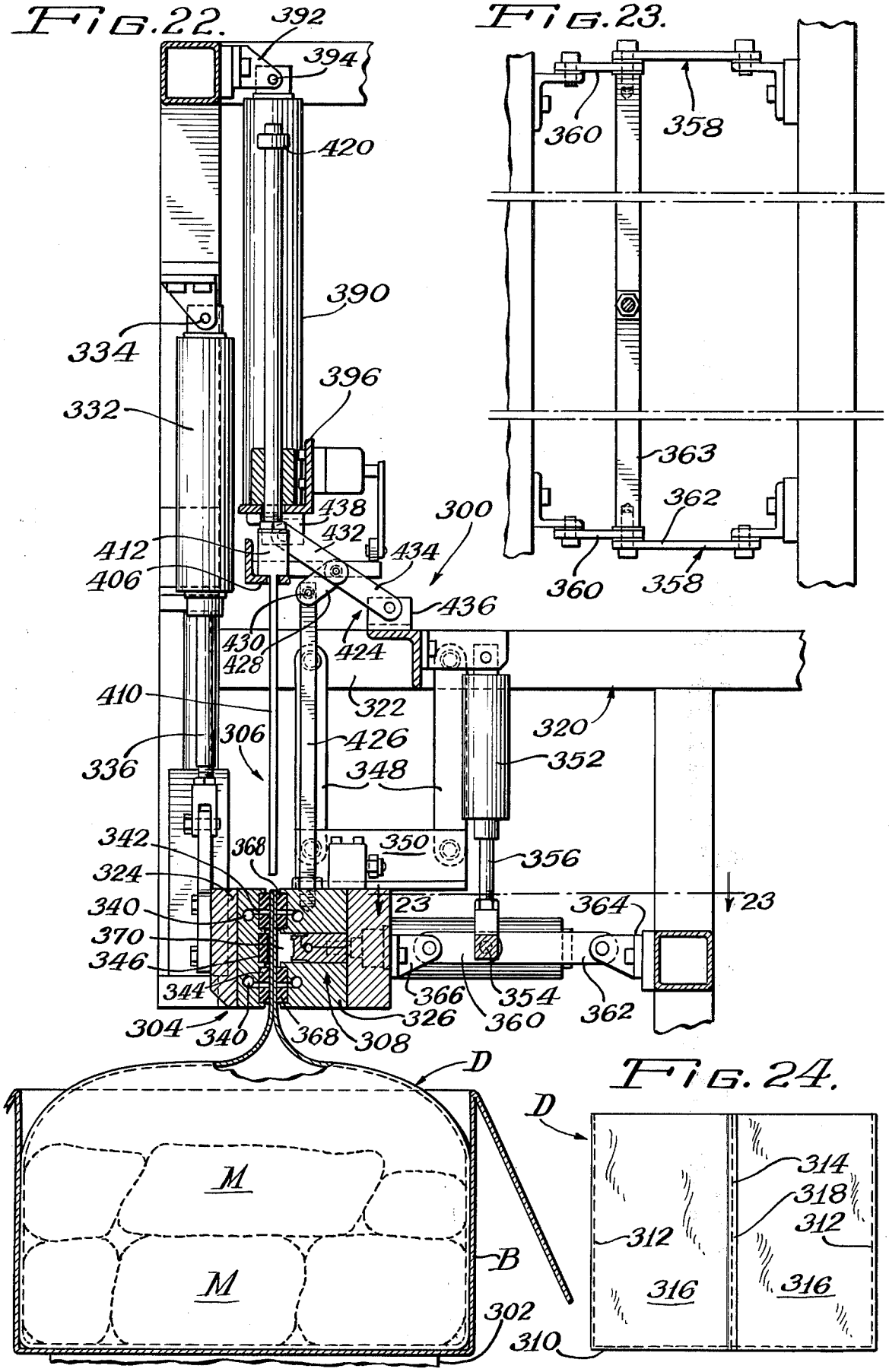
FIG. 22 is a side elevational, partially sectional view of another and preferred embodiment of apparatus useful for practicing our process.
FIG. 23 is a fragmentary, sectional view taken along the line 23—23 of FIG. 22.
FIG. 24 is a plan view of a flexible container or bag having two completely separate but separable product containing sections.
Figure 25:
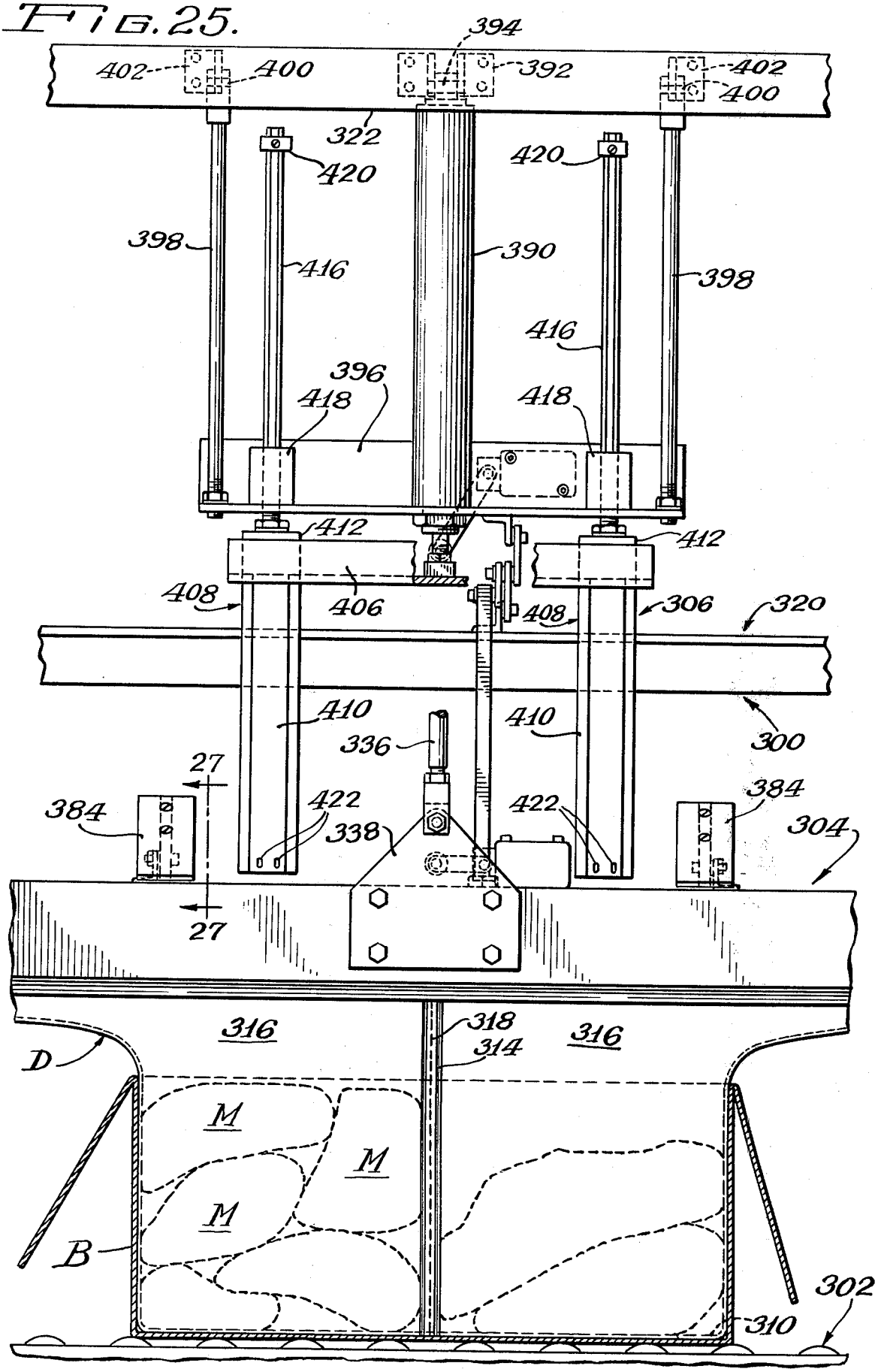
FIG. 25 is a front elevational view of the apparatus embodied in FIG. 22 during processing and using the double bag of FIG. 24.

As in the embodiment of FIGS. 1 – 20, the articles to be packaged, as meat pieces M, are placed within a flexible container D. The flexible container D as shown most clearly in FIGS. 24 and 25, is desirably constructed of the same heat sealable, gas impermeable material as the container C. The flexible container D is also substantially planar as seen in FIG. 24 and includes a sealed bottom 310 and sealed sides 312. The seals 310 and 312 are preferably heat seals. An intermediate seal section 314, which may be a single, relatively wide seal or two, separate but closely positioned seals, is positioned between the sides 312 to thereby define a pair of completely separate bag sections 316 having open upper ends. The bag D, preferably includes serration 318 centrally of the intermediate seal 314 to define not only separate, but separable bag sections. As will hereinafter described, the bag D, having the sections 316, may be advantageously used, for example, by lower volume butcher shops or restaurants, since the double section bag D permits one section to be separated from the other section and the contents therein used while the other bag sections is not disturbed and may be held for even longer periods of time without affecting the controlled interior thereof and exposing the interior to the atmosphere.

Figure 29:
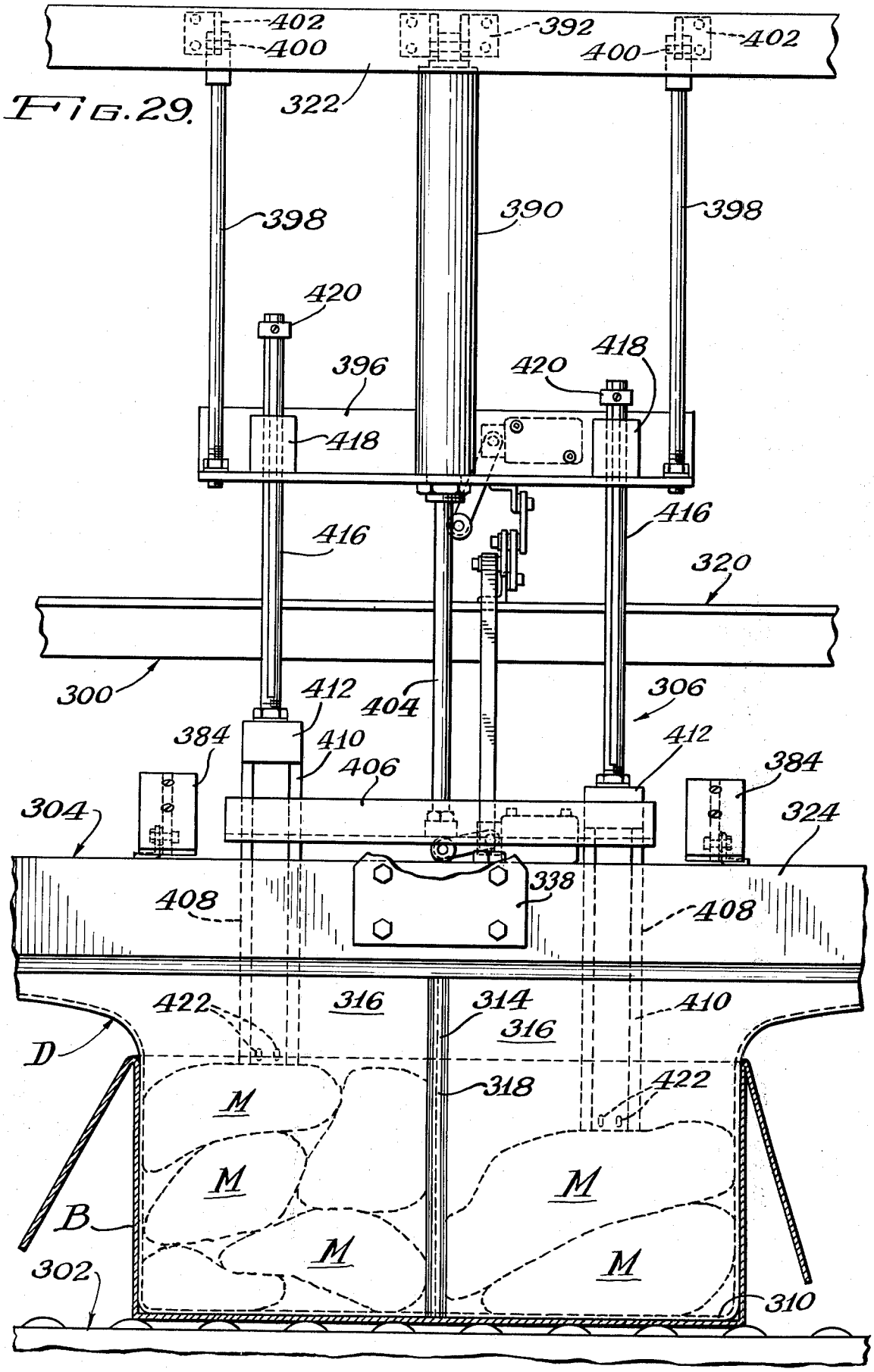
FIG. 29 is a front elevational view of the embodiment of FIG. 22 wherein the snorkels are shown in the operative position in a double bag container, particularly illustrating the feature of positioning the snorkels at different levels in the preferred embodiment.

In describing the embodiment of FIGS. 22–29, reference will be made specifically to the storage of meat pieces M within the double section bag D, as best seen in FIGS. 25 and 29. The apparatus 300 operates in substantially the same way as the apparatus 50, and the frame 302 is of substantially the same construction and includes an upright support frame 320 to which an overhead frame 322 is rigidly secured. Also, the bag support frame 302 is of substantially the same construction as the conveyor assembly 84 of the embodiment 50.

The bag gripping section 304 includes a vertically reciprocal front manifold 324 and a forwardly and rearwardly movable rear manifold 326. The opposite ends of the front manifold 324 are each guidably supported for vertical movement by bearing members (not shown) mounted at each end thereof having the same construction as the embodiment 50. As in the embodiment 50, the bearings are slidably guided by fixed upright rods (not shown) which are fixed to the support frame 322. The desired vertical reciprocal movement is imparted to the front manifold 324 by an air cylinder assembly 332.

The air cylinder assembly 332 is pivotally secured at 334 to the support frame 332 while the piston rod 336 thereof is rigidly secured at its outer end to a support bracket 338 which is fixedly secured to the central portion of the front manifold 324. Passageway 340 are provided in the front manifold 324 and the passageways 340 communicate with vacuum openings 324 in spaced upper and lower flexible sealing pads 344 on the front manifold 324. A flexible heat seal back up 346 is positioned intermediate the sealing pads 344.

The rear manifold 326 is guidabaly supported for forward and rearward movement by a pair of substantially upright pivot arms 348, pivotally secured at their upper ends to the overhead support frame 322. The lower ends of the pivot arms 348 are pivoted to a pair of brackets 350, which are secured to the opposite ends of the rear manifold 326.

The motive force for moving the rear manifold 326 to the forward position is of somewhat different construction from the assembly used for the apparatus 50. An air cylinder 352 is positioned in a substantially vertical position and is pivotally secured, generally above the rear manifold 326, at a pivot connection 353 with the overhead frame 322. The piston rod 356 of the air cylinder assembly 352 is pivotally secured to a toggle linkage 358. The toggle linkage 358 includes a front link 360 and a rear link 362. As seen in FIG. 23, two toggle linkages are used and interconnected to a tie bar 363. Each rear link 362 is pivotally secured at its rear end to a bracket 364 which is fixed to the upright frame 320 and at its forward end to the tie bar 363. The front link 360 is also pivotally secured to the tie bar 363 along the same axis as the rear link 362 while the forward end thereof is pivotally secured to a bracket 366 which is rigidly secured to the rear wall of the rear manifold 326.

The rod 356 is rigidly secured to the central portion of the bar 363. As seen in FIG. 22, when the air cylinder 352 is activated, the links 360 and 362 of the toggle mechanism 358 are movable into substantially axial alignment with each other to thereby positively clamp the rear manifold 326 against the front manifold 324, as in the embodiment 50. The rear manifold 326, as seen in FIG. 22, also includes upper and lower flexible sealing pads 368 which generally align with the vertically spaced sealing pads 344 on the front manifold 324. A hollow space 370 is defined in the rear manifold 326 between the spaced sealing pads 368.

Figures 26, 27, 28:
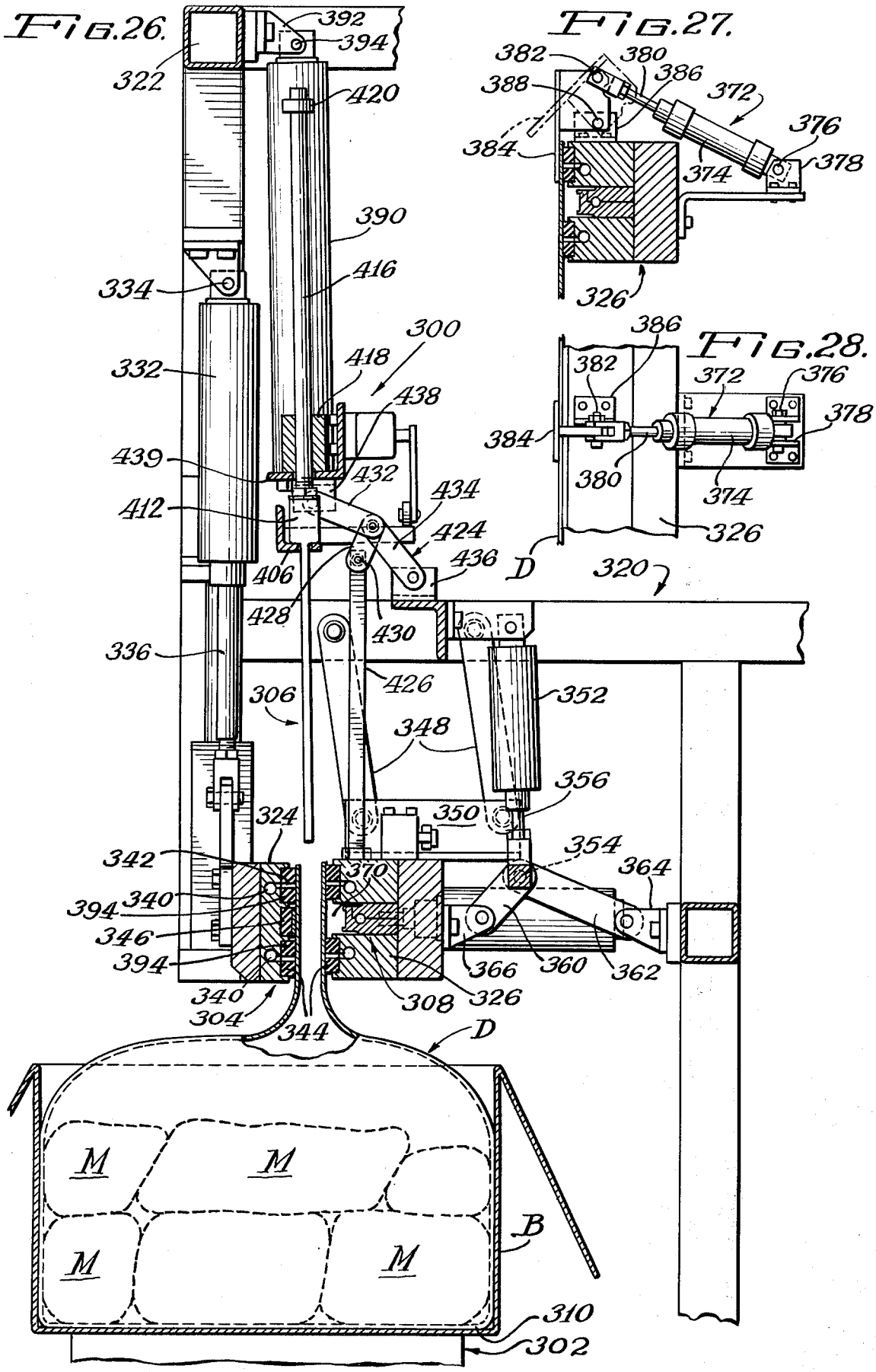
FIG. 26 is a view similar to FIG. 25 at the time the bag gripping manifolds hold the upper end of the bag in the open position for receiving the snorkel therein.
FIG. 27 is a detailed view showing a preferred form of mechanical bag clamping means in the inoperative position.
FIG. 28 is a plan view of the bag clamping means embodied in FIG. 27 in the operative position.

The bag clamping mechanism, generally 372, for the embodiment 300 is somewhat different from the bag clamping mechanism used in the apparatus 50. Referring to FIGS. 27 and 28, a pair of bag clamping mechanisms 372 are laterally spaced along the rear manifold 326 and operate to mechanically hold or clamp the upper edges of the bag D in a fixed position against the upper sealing pads 368 after the bag D has been manually positioned and before the bag D is under control of the vacuum provided in the manifolds 324 and 326. Each bag clamping mechanism 372 includes an air cylinder assembly 374, which is pivotally secured, at its cylinder end, to a pivot member 376 which, in turn, is secured to a support bracket 378. The bracket 378 is rigidly secured to the rear wall of the rear manifold 326. A piston rod 380 of the air cylinder 374 is pivotally secured at 382 to a clamping plate 384. The clamping plate 384 is pivotally secured to a bracket 386 at a pivot connection 388, and the clamp plate 384 includes a downwardly extending portion which is movable into position against the bag D to hold the upper edges of the bag D against the upper sealing pad 368 of the rear manifold 326. As with the embodiment 50, the bag clamps 372 act to hold the front bag panel in place, the rear bag panel being under the influence of the vacuum in the rear manifold 326.

The vacuumizing and gas addition assembly 306 of the apparatus 300 has significant advantages over that of the apparatus 50. The assembly 306 includes an upright air cylinder assembly, generally 390. As best seen in FIG. 29, the air cylinder assembly 390 is pivotally carried by a support 392 at a pivot connection 394. The support 392 is fixedly secured to the front of the overhead frame assembly 322. The lower end of the air cylinder assembly 390 is rigidly secured to a cross support 396 at a central portion thereof. In order to provide stability for the cross support 396, the opposite ends thereof, with the air cylinder assembly 390 positioned substantially intermediate thereof, have a pair of upright support rods 398 secured thereto. The rods 398 are pivotally secured at their upper ends to pivot connections 400 by a pair of support brackets 402 which are secured to the overhead frame 322. The pivot connections 400 are coaxial with the pivot connection 394 for the upper end of the air cylinder assembly 390. The lower ends of the rods 398 are rigidly secured to the opposite ends of the cross support 396. The rods 398, cross support 396, and wall portion of the air cylinder 390 generally define a pivoted frame.

The lower end of a piston rod 404 of the cylinder 390 is rigidly secured to a cross plate 406 which is positioned below and substantially parallel to the cross support 396. The cross plate 406, as seen in FIG. 29, is reciprocal between raised and lowered positions.

The cross plate 406 has laterally spaced apertures therein for vertically slidably carrying a pair of snorkel assemblies, generally 408, at the opposite ends thereof. Each snorkel assembly 408 projects downwardly and includes a substantially flattened hollow portion 410 having an upper flange 412 unitarily fixed thereon. Each flange 412 includes a passageway (not shown) therein which communicates with a central hollow passageway in the hollow member 410. The passageways in the flanges sealably interconnect with a flexible hose (not shown) or the like for selective communication with a vacuum source or pressurized gas.

In order to properly guide the snorkel assemblies 408 for upward and downward movement, the upper side of the flanges 412 each have a guide rod 416 fixed thereto and projecting upwardly therefrom in substantial alignment with the upright axis of the hollow member 410. Each guide rod 416 is slidably received by a bearing member 418 which is rigidly secured to the upper side of the cross plate 396, in a position intermediate the air cylinder assembly 390 and one of the support rods 398, in closer proximity to the rod 398. The upper end of each guide rod 416 includes a stop or positioning flange 420 which is rigidly secured thereto.

As seen, the snorkel assemblies 408 are vertically and slidably carried by the cross plate 406 and are insertable into the flexible container D. When the lower end of the hollow portion 410 of the snorkel engages a meat piece M, that snorkel 408 stops its downward descent. As indicated best in FIG. 29, even though one of the snorkel assemblies 408 stops, the other snorkel assembly 408 continues its downward movement until it also engages a meat piece M stored within the container D. The arrangement is considered to have significant advantages of the snorkel assembly used in the embodiment of apparatus 50 for better assuring proper evacuation. In the snorkel assembly 408, the flexible bag D, during evacuation, is far less likely to collapse around the vacuum openings 422 provided in the hollow members 410 because these openings are further away from adjacent bag panels which are likely to collapse. In this way, the desired vacuum in the flexible containers is more readily attainable to substantially remove all the air therefrom.

The apparatus 300 also includes a snorkel positioning assembly, generally 424, for properly aligning the snorkel assemblies 408 relative to the rear manifold, at all times, particularly for insertion and withdrawal of the assemblies into the container D. The positioning assembly 424 provides a more positive snorkel positioning and is preferred over the positioning assembly 258 used in the embodiment 50. The positioning assembly 424 includes a generally upright rod 426 which is rigidly mounted in a vertical position on the upper wall of the rear manifold 326. The upper end of the upright rod 426 is pivotally secured to an arm 428 at a pivot connection 430. The pivot connection 430 also pivotally interconnects with a linkage having a front link 432 and a rear link 434. The front link 432 and rear link 434 are positioned in a generally upwardly angled direction. The rear link 434 is pivoted at its rear end to a bracket 436 secured to the overhead frame 322. The front link 432 is pivoted at its rear end to a support bracket 438 which is mounted on the underside of the cross support 396.

When the rear manifold 326 is moved to the full forward position, as seen in FIG. 22, the upright rod 426 also moves forwardly thereby pivoting the arm 428. The arm 428 pivots the links 432 and 434 into axial alignment as seen in FIG. 22, to thereby positively position the snorkel assemblies 408 at the required location above the opening between the manifolds 324 and 326, which initially hold the bag D open, for insertion and withdrawal of the snorkel assemblies 408 into and from the bag D.

The heat sealing assembly 308 for the apparatus 300 has substantially the structure as the heat sealing assembly for the embodiment 50. Therefore, the heat sealing assembly 308 will not be described other than by reference to the embodiment 50.

OPERATION

The operation of both embodiments of our packaging apparatus, described above, that is, the apparatus 50, illustrated in FIGS. 1–20, and the embodiment 300 illustrated in FIGS. 22–29, will be described in conjunction with a description of our packaging process. For purposes of simplicity in description of the operation, reference will more generally be made to the apparatus 50 embodied in FIGS. 1–20. At times in this description, where there is a significant difference in operation as between the two embodiments, reference will be specifically made to the apparatus 300 embodied in FIGS. 22–29. Also, in describing the sequencing of the equipment, the various controls used will be described and reference will be made to the pneumatic flow diagram of FIG. 21 and the electric diagrams of FIGS. 21A and 21B. Also, various limit switches, not previously described, will be located and discussed in describing the operation and the paackaging process.

Referring first to FIGS. 1, 2, and 5, the operator of the apparatus 50 first places a flexible container C (or double section flexible container D) into an open, substantially rigid box B. Generally, at a separate station, the product to be packaged, as meat pieces M, are packed or placed, as seen in FIG. 5, in the flexible container C or D. When the desired quantity of meat has been placed into the flexible bag, the box B and its contents are transferred to the packaging apparatus and placed on the conveyor assembly 84. The box is moved along its longitudinal axis into a position where its opposite ends are substantially equally spaced inwardly from the opposite ends of the front and rear manifolds 132 and 134. The height of the assembly 34 will have been previously adjusted to the desired level.

When the box B is thus positioned, the open end of the flexible container C is in position to have the upper edges of the flexible container C held against the vacuum openings 188, in the pads 186, in the frontwardly facing rear manifold 134. Preferably, the machine frame 60 includes a rear flap hold down bar 440 and side flap hold down bar 442 to assist in keeping the rear and end flaps of the box B out of the operator's way during operation of the machine 50 or 300.

At this time, the operator grasps the panels of the bag C or D along its seams and along its open upper end and then manually stretches the upper ends of the panels into a substantially wrinkle-free condition, while the upper edges of the sides are positioned in substantial alignment with each other. A vacuum is then being applied to the openings 188 through the passageway 176 and through a hose 190 which is selectively interconnected with vacuum from the vacuum pump 124. The vacuum pump 124 desirably operates at a vacuum of about 25–29 inches Hg and this vacuum acts to hold the rear panel of the bag C or D in a substantially wrinkle-free, open condition against these vacuum openings 188. Atmospheric pressure acts against the rear panel of the flexible bag C or D along the vacuum openings 188 in both the upper and lower pads 186 of the rear manifold 134. The operator has a clear view of the rear manifold 134 because the front manifold is in a raised position and also the height of the rear manifold 134 is at substantially eye level.

Although the upper edges of the bag C or D are desirably positioned in a substantially horizontal position, slight misalignment is not detrimental to the operation. In this regard, it is more important for the opposite panels of the bag to be in such a position as to assure heat sealing thereof by the heat seal bar 280, which operation will be hereinafter described in greater detail. Three longitudinally spaced bag stops 183 are preferably mounted on the rear manifold 134 to assist the operator in properly initially positioning the bag C.

Referring to FIG. 12, the start of the automatic sequencing operation is shown. As shown, the heat sealing bar 280 is in the back or retracted position, the snorkels 246 are in the raised position, and the front manifold 132 is in the up position.

Figure 21:
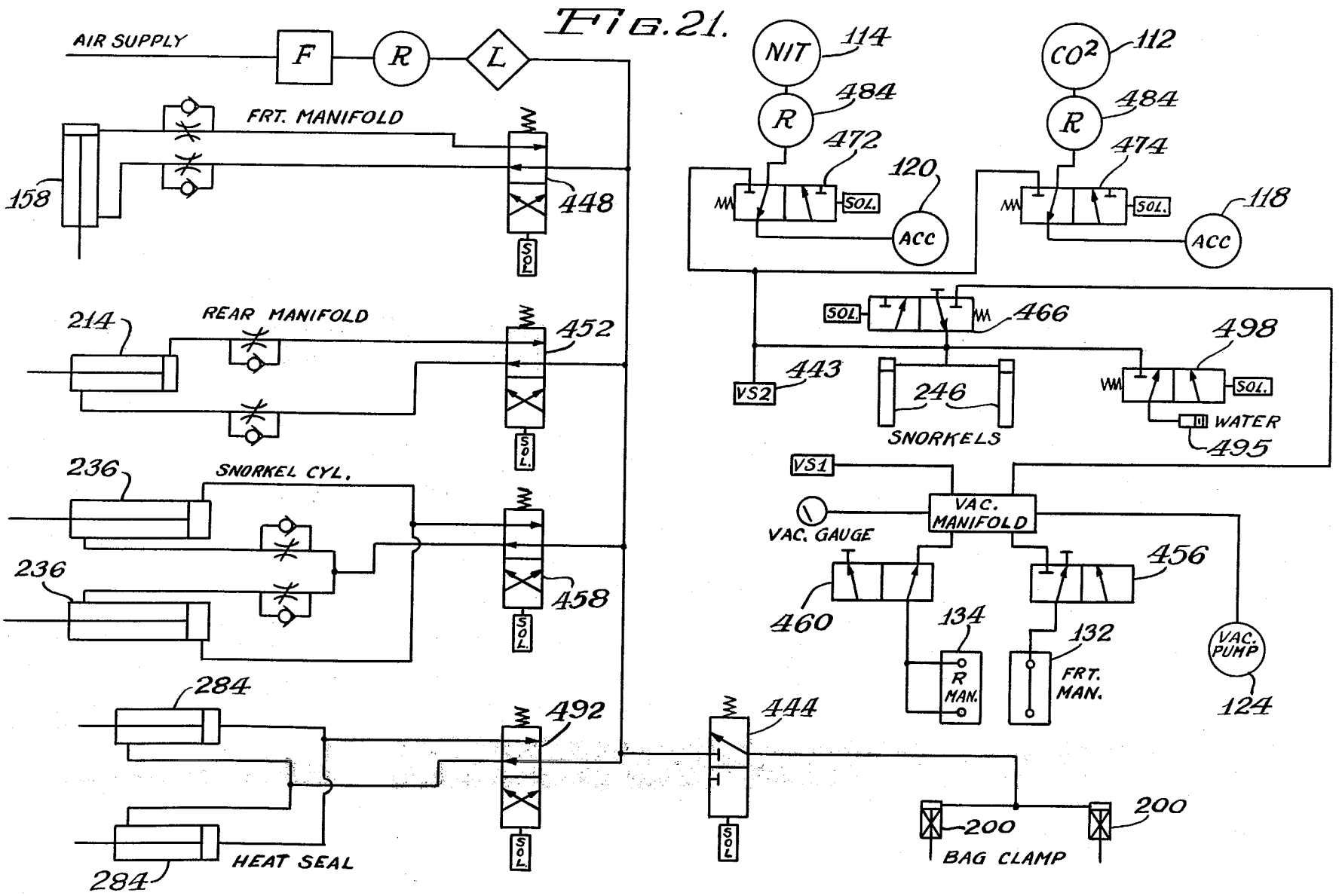
FIG. 21 is a pneumatic flow diagram for the mechanism shown in FIGS. 1 – 20.
Figure 21A:
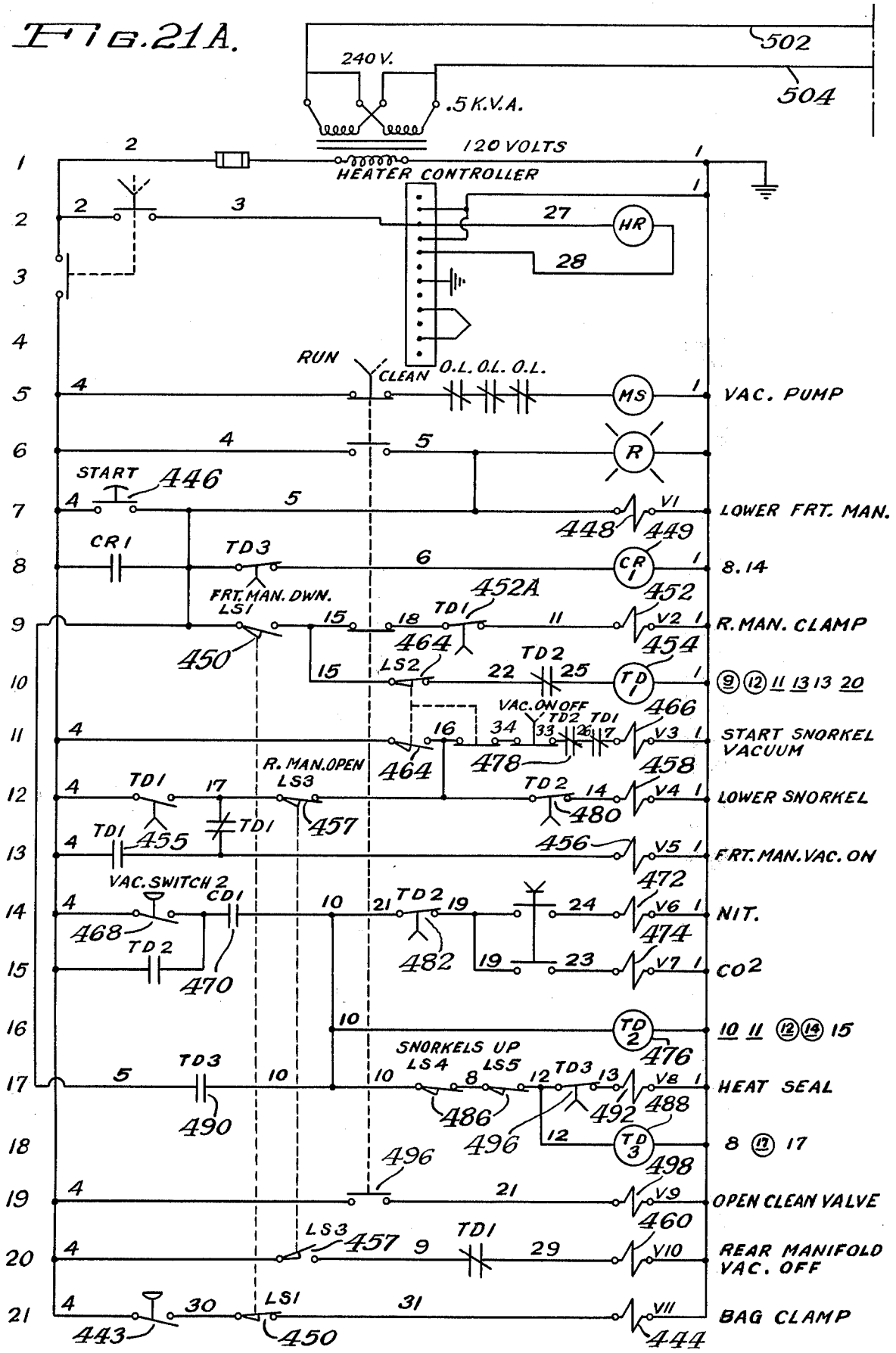
FIG. 21A is an electrical schematic diagram of the electrical controls used in the sequencing of the apparatus.

Once the operator has positioned the bag C or D in the described manner against the rear manifold, little further skill is required from the operator, as will be described. This is considered an important feature because of significant reduction in human error. When the bag C is manually held against the pad openings 188 in the rear manifold 134, referring to FIG. 21, vacuum switch 443 senses an increase in the vacuum in the vacuum lines because the openings 188 are closed to the atmosphere. When the switch 443 senses that a vacuum of about 15–18 inches Hg is reached, the bag clamp solenoid valve 444 is energized, as shown in FIG. 21, to permit pressurized air, at normal plant air pressure, to pass to both of the bag clamp air cylinders 200 of the embodiment 50, or in the embodiment 300, to the air cylinders 374. (In this description, the coil of each solenoid valve and the valve itself will be given the same reference number, for purposes of simplicity.) When this occurs, the bag clamping mechanisms 198 (or 372) are activated to mechanically clamp both panels and particularly the front panel of the bag C or D against the rear manifold, as best seen in FIGS. 8 and 9, for the embodiment 50 and in FIGS. 27 and 28, for the embodiment 300. After the bag clamps have been activated, in addition to their mechanical clamping function, their activation is a signal that the bag is properly positioned and sequencing may commence. Thereafter, the operator moves his hands out of the way of the manifolds and the manually operated switch 446, as seen in FIGS. 1 and 21A, is activated. From this time on, the entire sequencing operation for the equipment is completely automatic and little further manual skill is required. One of the few instances where assistance of the operator is called for is when the bag C appears to have air pockets, and may require the operator to manually move the bag panels to substantially eliminate the air pockets; even this is generally found only in the embodiment 50, and not in the embodiment 300.

Activation of the manual switch 446 performs several functions. First, the closing of switch 446 activates the front manifold solenoid valve 448, which, in turn, energizes the drive cylinder assembly 158, to permit pressurized air to enter the cylinder 158 and cause the front manifold 132 to move downwardly, as indicated in FIG. 12. The manual switch 446 further activates a relay 449, seen in FIG. 21A, the purpose of which will be hereinafter described.

Figure 10:
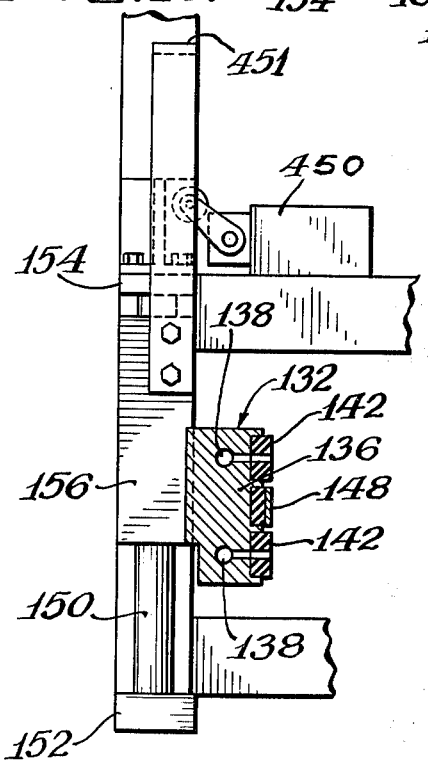
FIG. 10 is an enlarged detailed, fragmentary sectional view taken along the line 10—10 of FIG. 1.

As seen best in FIG. 10, a limit switch 450, mounted on the overhead frame 64, is positioned to be activated by a tripper 451 which is rigidly mounted on the overhead frame 64. When this occurs, the front manifold 132 is in the full down position and is generally horizontally aligned with the rear manifold 134, as seen in FIG. 13. The normally closed switch 450 is opened when the front manifold 132 is down, to thereby deactivate the bag clamps to move them out of the way when the rear manifold 134 is moved towards the front manifold 132.

Referring to FIG. 14, while the snorkels 246 are still in the up position, the rear manifold 134 is moved forwardly, like the de-activation of the bag clamps, when the limit switch 450 has been activated. The limit switch 450 also activates a rear manifold solenoid valve 452 through time delay switch 452A, as seen in FIGS. 21 and 21A, which permits pressurized air to be applied to the drive cylinder 214 to move the rear manifold 134 forwardly, as shown. As seen in FIG. 21A, when the limit switch 450 is closed, circuits controlled by a time delay relay 454 are affected. First, a switch 455 is activated to energize the vacuum solenoid 456 to apply vacuum to the front manifold. When the misaligned pad openings 144 and 188 in the front and rear manifolds 132 and 134 engage opposite sides of the bag C by means of vacuum in both manifolds, the front section of the bag C is under control of the front manifold 132 while the rear section or panel of the bag C is under control of the rear manifold 134.

When the delay switch 452A of the relay 452 times out, the valve closes and the cylinder 214 reverses movement to move the rear manifold 134 rearwardly, as indicated in FIG. 15, while the bag is opened because each bag panel is under the control of the vacuumized front and rear manifolds 132 and 134. When the rear manifold 134 reaches the full back position, a limit switch 457 is contacted. The snorkel solenoid valve 458, as seen in FIGS. 21 and 21A is energized to cause pressurized air to be applied to the snorkel cylinders 236 for moving the snorkels 246 downwardly into the bag C, which is opened below the snorkels.

The snorkel positioning assembly 258 (or 424) maintains the snorkels in a pre-determined position relative to the rear manifold. The assembly 258 (or 424) is mounted on the rear manifold and pivots the snorkel assembly in response to forward and reverse movement of the rear manifold. This positioning is particularly important in positioning the bottom of the snorkels 246 in aligned relationship with the open bag. The snorkels are positioned substantially intermediate the manifolds 132 and 134 and thereby centrally of the open portion of the bag.

The snorkels 246 enter the open upper end of the bag C, as generally shown in FIG. 15, while the rear manifold 134 is spaced back from the frost manifold 132. In the embodiment 50, of FIGS. 1–20, the bottoms of the snorkels 246 are positioned to a predetermined level in the bag C, but below the manifolds 132 and 134. The open portions in the bottoms of the snorkels must be completely within the bag C. The vacuum openings of the snorkels sometimes are closed by the bag panels and the operator may have to manually pull the bag panels from the vacuum openings in order to obtain a proper vacuum level.

In the embodiment of FIGS. 22–29, and as seen best in FIG. 29, the snorkels "float" or move to a level where the bottoms of the snorkels 408 actually engage the surface of the meat pieces M. The cylinder 390 moves the cross plate 406 downwardly and the cross plate 406 carries the snorkel members 408 downwardly. The snorkel flanges 412 rest on the cross plate 406. When the bottom of the hollow member 410 strikes the meat M within the container D, further downward movement of that snorkel is stopped even though the cross plate 406 continues its downward descent, together with the other snorkel 408. The other snorkel continues until it also strikes a meat piece. Thus, the hollow members 410 of the snorkel assemblies 408 extend downwardly into the flexible container to different levels, closer to the meat, thereby providing better assurance that the desired vacuum level will be reached without manipulation of the bag.

During the downward descent of the snorkel assemblies, the spacing of the snorkels from the front and rear manifolds is determined, in the apparatus 50, by the snorkel positioning assembly 258 and, in the embodiment 300, by the positioning assembly 424.

Figure 11:
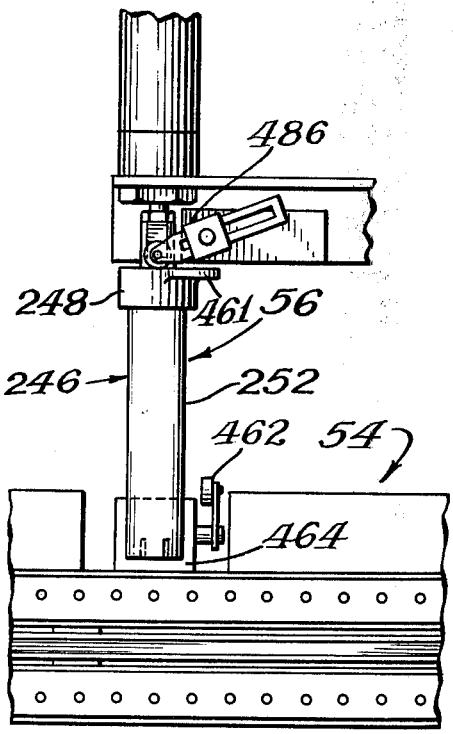
FIG. 11 is a detailed view showing limit switches mounted on the passage defining means, which switches are useful in the sequencing of the apparatus.

Referring to FIG. 11, a trip arm 461 on the snorkel assembly 246 strikes the arm 462 on a limit switch 464, mounted on top of the rear manifold 134, for signaling when the snorkels 246 are in the down position. When the switch 464 is so energized, it opens a circuit to de-energize the relay 454 and closes a circuit to energize the coil of a solenoid 466 and open the interior of the snorkels 246 to vacuum, as seen in FIGS. 21 and 21A.

When the relay 454 has been de-energized, the normally closed delay switch 454A closes and the solenoid valve 452 is energized again, to move the rear manifold forwardly.

When the rear manifold moves forward, the limit switch 457 changes circuits, as seen in FIG. 21A, to de-energize solenoid 456 and energize solenoid 460, and thereby cut vacuum to both manifolds 132 and 134. As there is only a fraction of a second involved, residual vacuum holds the bag in place until the manifolds are clamped together. Because the pads on the manifolds are flexible, the interior of the bag C is sealed from the atmosphere. The snorkels 246 are in sealing engagement with the bag panels which form around the hollow, passage defining portions of the snorkels. When the container C is effectively sealed from the atmosphere, air is drawn from the container C through the snorkels 246 to remove substantially all the air therefrom and create a vacuum therein. A suitable vacuum level is considered to be in the range of about 25–29 inches Hg. When the solenoid valve 468, as seen in FIGS. 21 and 21A, detects a vacuum in the desired range of about 25–29 inches Hg, vacuum switch 468 closes. The switch 470 having been closed previously by the relay 449, and the closed vacuum switch 468 cause the coils of the nitrogen solenoid valve 472 and of the carbon dioxide solenoid valve 474 to be energized. The vacuum switch 470 also energizes a relay 476 which, in turn, opens the switch 478 and cuts vacuum to the snorkels. With the vacuum cut, a pre-determined quantity of carbon dioxide and nitrogen in the accumulators 118 and 120 are charged into the evacuated bag C or D.

The amount of carbon dioxide and nitrogen added to the container may vary over a wide range, depending on the material and amount thereof being packaged, and the size of the bag and its closed volume. In practice, the accumulators are capable of receiving a measured volume of gas at a preselected pressure. Simply by changing the pressure level, the amount of gas which is added to the bag can vary. In one example, 414 cubic inches of nitrogen and 414 cubic inches of carbon dioxide are added to the bag C per 75 pounds of beef; this provides a 50 percent concentration of carbon dioxide in the bag. Depending on the various parameters, the added gas can vary over a wide range, as 2–10 cubic inches per pound of meat product for each of the gases.

Although the nitrogen is not considered to have any significant preserving effect on the meat, it is believed that the nitrogen functions to reduce the concentration of the carbon dioxide. If the concentration of carbon dioxide is at too high a level, the meat, as beef, begins to turn gray or darken, an undesirable condition. Thus, the nitrogen, basically an inert gas, serves the important function of providing a concentration of carbon dioxide at such a level that the meat does not darken from exposure to carbon dioxide over extended periods of time. It is considered an important feature of the process to maintain the natural color of the fresh red meat, even over extended periods of time, as for 30 to 45 days.

Carbon dioxide is important in reducing bacteria growth. Bacteria is generally always present on the surface of meat. In order to reduce the growth of aerobic bacteria, air is first removed, and then, in order to inhibit the growth of the aerobic bacteria, carbon dioxide is added. Carbon dioxide also has the important effect of reducing or inhibiting the growth of anaerobic bacteria. Although vacuumizing is important for greatly reducing the amount of enclosed air, residual air is generally present in the bag and without the carbon dioxide, aerobic bacteria, as well as anaerobic bacteria, can grow over extended periods of time. Such growth could be detrimental and cause the bacteria level to increase beyond acceptable limits when the apparatus 50 (or 300) is used in the packaging of food products, as fresh meat. For these reasons, carbon dioxide, at appropriate concentrations, is important.

It is also important in the process that, after vacuumizing, the pressure in the flexible container is at substantially atmospheric pressure, or slightly below. In the case of a vacuumized container C, the bag is normally tight against the meat. Particularly in large bulk packaging of products, as 50–100 pound packages, a condition at which the bag C is taut makes the bag susceptible to breakage. Also, if the gas pressure within the container C or D exceeds atmospheric pressure, the bag can actually expand and become stretched. A bag that is expanded from pressure in excess of atmospheric is also considered undesirable and susceptible to breakage during handling. Thus, the container C should be in a substantially relaxed condition, after complete processing, so as to be less susceptible to breakage, as opposed to a flexible bag which is vacuumized or which is expanded from pressure therein.

The vacuum switch 468, when closed, energizes the time delay relay 476, as previously described. The relay 476 includes a delay switch 480 which opens after a time delay sufficient to assure that the desired gases have been added to the bag. Opening switch 480 de-energizes the coil of the solenoid 458, to cause the snorkels 246 to move upwardly and out of the bag C. A delay switch 482 of the relay 476 also opens to de-energize solenoids 472 and 474 and close off the accumulators to the snorkels and open them to be charged with the desired volume of gases from the carbon dioxide and nitrogen tanks. The pressure regulators 484 control the pressure and thereby volume of gases added to the respective accumulators.

As seen in FIG. 17, the manifolds 132 and 134 remain in sealing relationship with the sides of the bag C so that during the withdrawal of the snorkels 246, the sealing of the open upper end of the bag C is substantially unaffected because of the double, rear flexible sealing pads and the gaseous atmosphere therein remains substantially the same. Also, since the gas in the container C or D is at substantially the same pressure as the atmomsphere, there is no tendency either for air to enter the bag or for the gas to leave the container C.

When the snorkels 246 have reached their full up position, limit switches 486 are held in a closed position. A delay relay 488 is energized by the closing of the limit switches 486. Also, this energizes the heat seal bar solenoid valve 492 to cause pressurized air to operate the air cylinders 284 to move the heat bar 280 forwardly to the heat sealing position. The bar 284 heats the adjacent bag panels to provide the heat seal 494 on the bags C or D. The relay 488 also includes a delay switch 496 which is timed to open when the desired amount of heating has occured. The opening of this switch de-energizes the solenoid 492 and the heat seal bar 280 retracts.

At this time, the entire vacuumizing, gas adding and heat sealing cycle having a variable duration, as about 15–25 seconds, is complete and the front manifold 132 returns to the up or start position. When the front manifold 132 moves upwardly, the limit switch 450 opens and the rear manifold 134 moves rearwardly because the solenoid valve 452 is de-energized. The bag C and box B are moved away from the machine for sealing of the flaps and the machine is ready for a new cycle.

In the foregoing description, it is to be understood that only the more important aspects of the sequencing have been described, and there may be other sequencing operations occurring which are not herein described, but which are schematically shown.

Preferably, a water supply 495 may be provided for flushing the various lines with water, as seen in FIG. 21. When the switch 496 is manually closed, the solenoid valve 498 is energized causing rinse water to clean the lines.

Figure 21B:
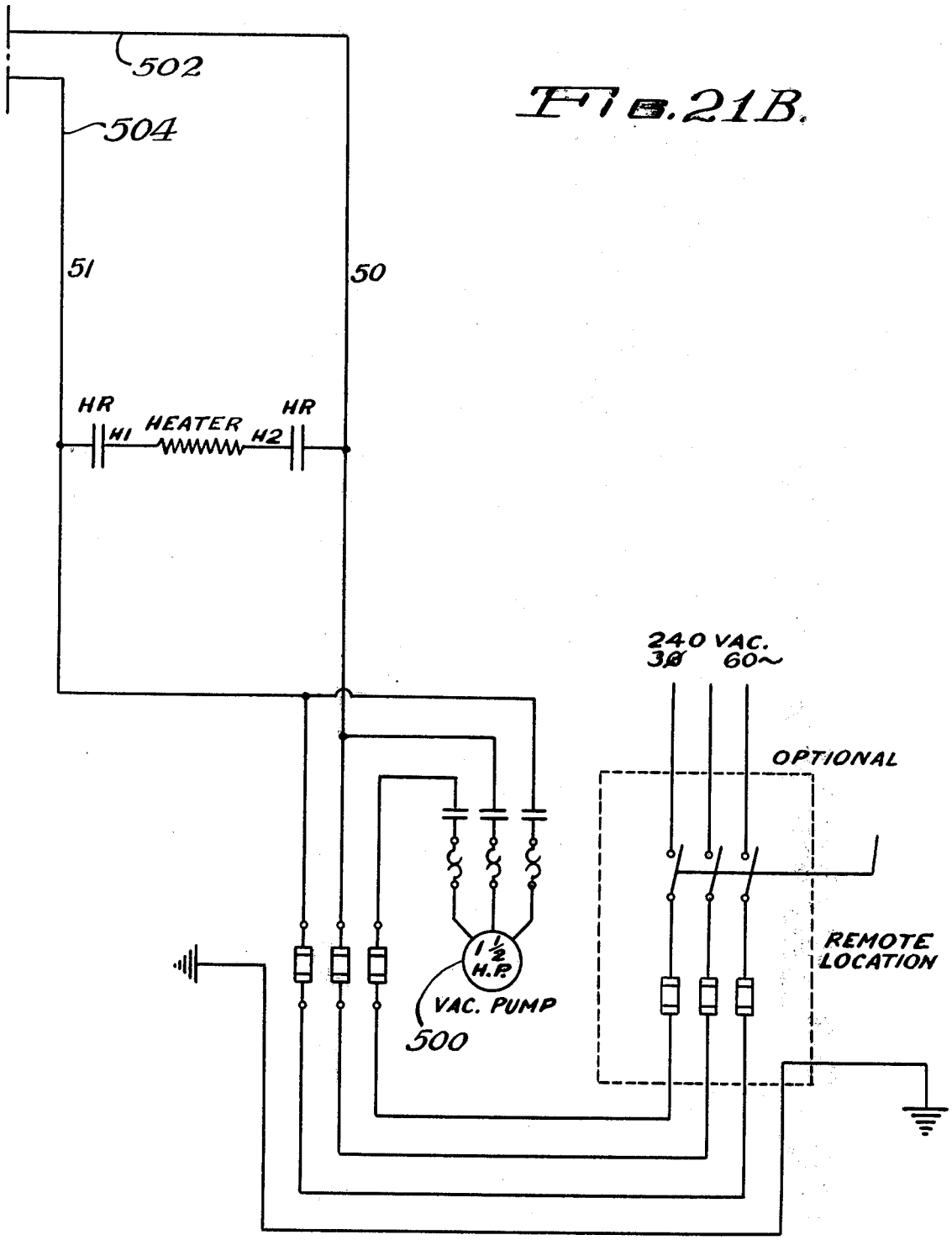
FIG. 21B is another electrical schematic diagram showing the motor controls for a vacuum pump; and heat sealer heating element.

Referring to FIG. 21B, the electrical schematic for the vacuum pump motor 500 is shown. The fusing and grounding thereof is shown. The lines 502 and 504 are the same as lines 502 and 504 in the electrical schematic of FIG. 21A.

The thus processed packaged meat may be stored at refrigrating temperatures as about 35°–50° F. for periods of time as much as 45 days without adversely affecting the fresh red color of the fresh meat and without unduly increasing the bacteria count, whether aerobic or anaerobic bacteria are involved, beyond acceptable levels for human consumption.

One important result of the process is that the packaged meat product permits natural tenderization to occur without mold growth. As an example, a beef rib, packaged as above, may be stored at a temperature of about 41° F. for fifteen to thirty days and the meat is tender and tasty. The aging or tenderization time can be significantly decreased by storing the meat at a higher temperature, as about 50°–59° F., for 3 to 5 days, while retaining the red color of the meat and maintaining a low bacteria count. Even after opening the package, the shelf life of the meat in a normal atmosphere and at 36° F. is approximately 10 days.

While in the foregoing, there has been provided a detailed description of particular embodiments of the present invention, it is to be understood that all equivalents obvious to those having skill in the art are to be included within the scope of the invention as claimed.

What we claim and desire to secure by Letters Patent is:

1. Apparatus for packaging articles in a substantially gas impermeable flexible container having an open end, said apparatus comprising, in combination, means for supporting said flexible container with said articles therein in a substantially fixed position relative to said apparatus, means for releasably gripping said container on opposite sides thereof along said open end, means for moving said gripping means between open and closed positions while carrying said container sides, passage defining means, means for moving said passage defining means into and out of said container, means for temporarily sealing said flexible container along said gripping means whether said passage means is in or out of said container, said temporary sealing means being carried by said gripping means, means for selectively vacuumizing and adding a gas into said container through said passage defining means while said container is temporarily sealed, said temporary sealing means maintaining said container in said temporarily sealed condition as said passage defining means is being moved out of said container, and means for effecting a self-sustaining seal of the sides of said container after said passage defining means is out of said container for maintaining said gas in said container and while said temporary sealing means continues to maintain said container in a sealed condition.

2. The apparatus of claim 1 wherein said supporting means is positioned below said gripping means and below said passage defining means.

3. The apparatus of claim 2 wherein said supporting means is vertically adjustable so that the vertical position of said packaged articles may be adjusted relative to said passage defining means.

4. The apparatus of claim 1 wherein said releasable gripping means comprises a pair of horizontally positioned, elongated members for controllably gripping opposite sides of said flexible container while said sides are in a substantially flattened, wrinkle-free condition.

5. The apparatus of claim 4 wherein said elongated members comprise spaced vacuum manifolds having a plurality of vacuum openings therein, and means are provided for supplying vacuum to said openings for holding the opposite sides of said bag in the open condition at selected times.

6. The apparatus of claim 5 wherein said vacuum openings are misaligned with each other so that both of said manifolds grasp the opposite sides.

7. The apparatus of claim 4 wherein said temporary sealing means comprise flexible sealing members positioned on said elongated members and in opposition to each other, said flexible sealing members being capable of sealing around said passage defining means when said passage defining means are in said container and when said elongated members are in the gripping condition.

8. The apparatus of claim 5 wherein said temporary sealing means are mounted on said vacuum manifolds and include spaced upper and lower flexible sealing pads capable of sealing around said passage defining means when said manifolds are in the closed, gripping condition.

9. The apparatus of claim 1 wherein said gripping means includes a pair of spaced, substantially horizontal, elongated members, each of said members receiving one side panel of said flexible container, and means are provided for moving said elongated members into and out of a container closing position.

10. The apparatus of claim 9 wherein said elongated members comprise vacuum manifolds having a plurality of vacuum openings therein, means for selectively supplying vacuum to said openings, said temporary sealing means comprise flexible sealing members mounted on said elongated members for sealably closing said flexible container both when said passage defining means are in said container and when said passage defining means are out of said container.

11. The apparatus of claim 9 wherein said seal effecting means comprise heat sealing means and are contained within said elongated members.

12. The apparatus of claim 10 wherein said seal effecting means comprise heat sealing means and are contained within said vacuum manifolds.

13. The apparatus of claim 1 wherein said passage defining means comprises substantially upright, hollow members having passages defined therein and control means are provided for selectively operating said inserting means for moving said hollow members into and out of said container at pre-selected intervals.

14. The apparatus of claim 13 wherein said hollow passage defining members are substantially flattened with a hollow interior, and said temporary sealing means comprises flexible sealing means mounted on said gripping means for sealably engaging said passage defining means to close the interior of said container to the atmosphere.

15. The apparatus of claim 1 wherein said inserting means comprises drive means for operating said inserting means for moving said passage defining means in and out of said container, control means for operating said drive means, and means for positioning said passage defining means relative to said gripping means for movement of said passage defining means in and out of said container.

16. The apparatus of claim 15 wherein said positioning means includes air cylinder means, said inserting means includes air cylinder means, both of said air cylinders being operated by control means for sequencing the operation thereof at pre-selected intervals.

17. The apparatus of claim 1 wherein said vacuumizing and gas adding means includes a vacuum source and a gas source, and control means are provided for sequencing said apparatus to first vacuumize said container and thereafter adding said gas thereinto.

18. The apparatus of claim 1 wherein said heat sealing means includes an elongated heat sealing bar and a spaced heat seal back up member, said heat sealing bar and said back up means being mounted on said releasable gripping means.

19. The apparatus of claim 1 wherein said releasable gripping means comprise substantially horizontally spaced vacuum manifold members, and said heat sealing means comprises a heat sealing bar in one of said manifolds and a back up means in the other of said manifolds, and means are provided for moving said heat sealing means against said back up means with the side panels of said flexible container being positioned therebetween for receiving a heat seal thereon.

20. The apparatus of claim 1 wherein control means are provided for operating said moving means for moving said passage defining means in and out of said flexible container.

21. The apparatus of claim 1 including means for clamping the upper ends of both panels of said flexible containers together before said releasable gripping means have control over both of said panels.

22. The apparatus of claim 21 wherein said releasable gripping means comprises spaced vacuum manifold means and said bag clamping means are mounted on only one of said manifolds.

23. The apparatus of claim 1 wherein said inserting means moves said passage defining means to a preselected level in said flexible container.

24. The apparatus of claim 1 wherein said inserting means includes means for moving said passage defining means to a level determined by the level of said articles within said container.

25. The apparatus of claim 24 wherein the descent of said passage defining means into said container is stopped, while said inserting means continues its descent.

26. The apparatus of claim 25 including a plurality of said passage defining means, each of which is moveable to a different level as determined by the level of the articles being packaged and positioned below each of said passage defining means.

27. The apparatus of claim 1 including means for continually positioning said passage defining means in aligned relationship with said open end to thereby assure proper movement of said passage defining means into said container.

28. The apparatus of claim 27 wherein said positioning means is mounted on said releasable gripping means.

29. The apparatus of claim 1 wherein said temporary sealing means defines first and second spaced apart seals so that as said passage defining means is moved out of said container and past said first temporary seal, said first seal assures maintenance of said temporary seal.

30. The apparatus of claim 29 wherein said permanent sealing means is a heat sealing means and is positioned intermediate said spaced temporary seals.

31. Apparatus for packaging articles in a substantially gas impermeable flexible container having an open end, said apparatus comprising, in combination, means for supporting said flexible container with said articles therein, means for releasably gripping said container on opposite sides thereof along said open end, passage defining means, means for inserting said passage defining means into and out of said container, means for temporarily sealing said flexible container along said gripping means whether said passage means is in or out of said container, means for first vacuumizing said container and thereafter adding a gas thereto through said passage means while said container is temporarily sealed, means for effecting a self-sustaining seal for said container after said passage means is moved from said container, and control means, said control means including manually operated means and automatic sequencing means, said manual means commencing the operation of said sequencing means, and said sequencing means thereafter operates said gripping means, said inserting means, said vacuumizing and gas adding means, and said sealing means without further manual operation.

32. The apparatus of claim 31 wherein supporting means is positioned below said gripping means and below said passage defining means.

33. The apparatus of claim 31 wherein said supporting means is vertically adjustable so that the vertical position of said packaged articles may be adjusted relative to said passage defining means.

34. The apparatus of claim 31 wherein said releasable gripping means comprises a pair of horizontally positioned, elongated members for controllably grasping opposite sides of said flexible container while said sides are in a substantially flattened, wrinkle-free condition.

35. The apparatus of claim 34 wherein said elongated members comprise spaced vacuum manifolds having a plurality of vacuum openings therein, and means are provided for supplying vacuum to said openings for holding the opposite sides of said bag in the open condition at selected times.

36. The apparatus of claim 25 wherein said vacuum openings are misaligned with each other so that both of said manifolds grasp the opposite sides.

37. The apparatus of claim 34 wherein said temporary sealing means comprise flexible sealing means positioned on said elongated members and in opposition to each other, said flexible sealing members being capable of sealing around said passage defining means when said passage defining means are in said container and when said elongated members are in the gripping condition.

38. The apparatus of claim 35 wherein said temporary sealing means are mounted on said vacuum manifolds and include spaced upper and lower flexible sealing pads capable of sealing around said passage defining means when said manifolds are in the closed, gripping condition.

39. The apparatus of claim 31 wherein said gripping means includes a pair of spaced, substantially horizontal elongated members, each of said members receiving one side panel of said flexible container, and means are provided for moving said elongated members into and out of a container closing position.

40. The apparatus of claim 39 wherein said seal effecting means comprise heat sealing means and said elongated member comprise vacuum manifolds having a plurality of vacuum openings therein, means for selectively supplying vacuum to said openings, said temporary sealing means comprises flexible sealing members mounted on said elongated members for sealably closing said flexible container both when said passage defining means are in said container and when said passage defining means are out of said container.

41. The apparatus of claim 39 wherein said seal effecting means comprise heat sealing means which are contained within said elongated members.

42. The apparatus of claim 40 wherein said heat sealing means are contained within said vacuum manifolds.

43. The apparatus of claim 31 wherein said passage defining means comprises substantially upright, hollow members having passages defined therein and control means are provided for selectively operating said inserting means for moving said hollow members into and out of said container at preselected intervals.

44. The apparatus of claim 43 wherein said hollow passage defining members are substantially flattened with a hollow interior, and said temporary sealing means comprise flexible sealing means mounted on said gripping means for sealably engaging said passage means to close the interior of said container to the atmosphere.

45. The apparatus of claim 31 wherein said inserting means comprises drive means for operating said inserting means for moving said passage defining means in and out of said container, control means for operating said drive means, and means for positioning said passage defining means relative to said gripping means for movement of said passage defining means in and out of said container.

46. The apparatus of claim 45 wherein said positioning means includes air cylinder means, said inserting means includes air cylinder means, both of said air cylinders being operated by control means for sequencing the operation thereof at pre-selected intervals.

47. The apparatus of claim 31 wherein said vacuumizing and gas adding means includes a vacuum source and a gas source, and control means are provided for sequencing said apparatus to first vacuumize said container and thereafter add said gas thereinto.

48. The apparatus of claim 31 wherein said seal efffecting means comprise heat sealing means which include an elongated heat sealing bar and a spaced heat seal back up member, said heat sealing bar and said back up means being mounted on said releasable gripping means.

49. The apparatus of claim 31 wherein said releasable gripping means comprises substantially horizontally spaced vacuum manifold members, and wherein said seal effecting means comprise heat sealing means which comprise a heat sealing bar in one of said manifolds, and a back up means in the other of said manifolds, and means are provided for moving said heat sealing means against said back up means with the side panels of said flexible container being positioned therebetween for receiving a heat seal thereon.

50. The apparatus of claim 49 wherein control means are provided for operating said moving means for moving said passage defining means in and out of said flexible container.

51. The apparatus of claim 31 including means for clamping the upper ends of both panels of said flexible container together before said releasable gripping means have control over both of said panels.

52. The apparatus of claim 51 wherein said releasable gripping means comprises spaced vacuum manifold means and said bag clamping means are mounted on only one of said manifolds.

53. The apparatus of claim 31 wherein said releasable gripping means comprises spaced vacuum manifolds, said control means comprises a vacuum switch operative when the vacuum of said manifold with said bag panel thereagainst is at a preselected level, flexible container clamping means responsive to said vacuum switch means are provided for temporarily clamping the upper side of both sides of said bag, and said manual means comprises a manual switch for commencing the operation of the said sequencing means.

54. The apparatus of claim 31 wherein said container gripping means includes an elongated front vacuum manifold and an elongated rear manifold, said elongated front manifold being movable from a raised position to a lowered position as said manual means commences the operation of said sequencing means, and limit switch means detect when said front manifold means is in the lowered position.

55. The apparatus of claim 54 including drive means for moving said rear manifold forwardly and clamping said rear manifold against said front manifold with said flexible container secured thereto, and said last mentioned drive means being responsive to said limit switch for indicating that said front manifold is in the down position.

56. The apparatus of claim 55 including switch means indicating that said rear manifold is in the forward position and vacuum means in said front and rear manifold operatively grip each of said panels, and said switch means operate said drive means to return said rear manifold to the rearward positon so that said bag is held in the open condition by said manifolds, with said flexible panels spaced away from each other.

57. The apparatus of claim 56 including switch means for indicating said rear manifold is in the back position, and drive means responsive to said last mentioned switch means are provided for moving said passage defining means downwardly for insertion into said flexible container.

58. The apparatus of claim 57 wherein said vacuumizing means creates a vacuum at a preselected level in said container, a vacuum switch is responsive to said preselected level for shutting said vacuum to said passage defining means, and control means are provided for adding said oxygen free gas into said container through said passage defining means after said vacuum is shut.

59. The apparatus of claim 58 including switch means for detecting the completion of gas addition into said flexible container, and drive means responsive to said switch means are provided for raising said hollow passage defining means out of said container, while said container remains in the sealed condition and drive means also responsive to said switch means for operating said seal effecting means for sealing said flexible container.

60. The apparatus of claim 59 including switch means for detecting the end of said sealing operation and for returning the rear manifold to the rearward position, said front manifold to the raised position, and said sealing means to the retracted position to complete the cycle of operation.

61. Apparatus for bulk packaging a plurality of articles in a flexible container having an open end, said apparatus comprising, in combination, means for supporting said flexible container with said articles therein in a substantially fixed position relative to said apparatus, laterally spaced means for releasably gripping said container on opposite sides thereof along said open end, passages defining means, means for positioning said passage defining means in an aligned position relative to the open end of said container, means for moving said passage defining means into and out of said container, means carried by said gripping means for temporarily sealing said flexible container along its open end whether said passage means is in or out of said container, means for creating a controlled interior for said container through said passage means while said container is temporarily sealed by said sealing means, and means carried by said gripping means for self-sustainingly sealing said container along its open end after said passage defining means is out of said container.

62. The apparatus of claim 61 wherein said releasable gripping means comprises a pair of horizontally positioned, elongated members for controllably gripping opposite sides of said flexible container while said sides are in a substantially flattened wrinkle-free condition.

63. The apparatus of claim 61 wherein said gripping means includes a pair of spaced, substantially horizontal elongated members, each of said members receiving one side panel of said flexible container, and means are provided for moving said elongated members into and out of a container closing position.

64. The apparatus of claim 61 wherein said passage defining means comprises substantially upright, hollow members having passages defined therein and control means are provided for selectively operating said inserting means for moving said hollow members into and out of said container at preselected intervals.

65. A mechanism for positioning a snorkel member in a flexible container, said mechanism comprising, in combination, first and second manifolds, vacuum means in said manifolds for gripping the opposite sides of said flexible container, means for moving said manifolds and thereby said sides of said container between open and closed positions, snorkel means, means for moving said snorkel means in the same direction as said manifold, and means for aligning said snorkel means with the opening between said manifolds thereby with the opened container for insertion of said snorkel means into said container.

66. The mechanism of claim 65 wherein said first manifold is movable between aligned and misaligned positions relative to said second manifold, and said aligning means is mounted on said second manifold.

67. The mechanism of claim 65 including flexible sealing means mounted on said manifolds for seaing said container and sealing around said snorkel means when said snorkel means are inserted into said container.

68. The mechanism of claim 66 including heat seal means carried on said manifolds for providing a heat seal for said container.

69. The mechanism of claim 66 including means for vacuumizing said container through said snorkel means.

70. The mechanism of claim 66 including means for controlling the addition of gas into said container through said snorkel means.

71. The apparatus of claim 66 wherein said aligning means positions and snorkel means substantially intermediate said manifolds in the open position to assure proper insertion of said snorkel means into said container.

* * * * *